US010871089B2

(12) United States Patent
Vance

(10) Patent No.: US 10,871,089 B2
(45) Date of Patent: Dec. 22, 2020

(54) SELF-CONTAINED E-FOOT

(71) Applicant: Eaton Intelligent Power Limited, Dublin (IE)

(72) Inventor: Matthew A. Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/340,251

(22) PCT Filed: Oct. 9, 2017

(86) PCT No.: PCT/US2017/055785

§ 371 (c)(1),
(2) Date: Apr. 8, 2019

(87) PCT Pub. No.: WO2018/068045

PCT Pub. Date: Apr. 12, 2018

(65) Prior Publication Data

US 2020/0056512 A1 Feb. 20, 2020

Related U.S. Application Data

(60) Provisional application No. 62/554,909, filed on Sep. 6, 2017, provisional application No. 62/549,471, filed (Continued)

(51) Int. Cl.
*F01L 1/34* (2006.01)
*F01L 3/00* (2006.01)

(Continued)

(52) U.S. Cl.
CPC ..... *F01L 3/00* (2013.01); *F01L 1/04* (2013.01); *F01L 1/185* (2013.01); *F01L 1/20* (2013.01);

(Continued)

(58) Field of Classification Search
CPC . F01L 1/185; F01L 1/2405; F01L 1/20; F01L 1/04; F01L 1/46; F01L 13/0036;

(Continued)

(56) References Cited

U.S. PATENT DOCUMENTS 5,544,626 A 8/1996 Diggs et al.
6,314,928 B1 11/2001 Baraszu et al.

(Continued)

FOREIGN PATENT DOCUMENTS

WO WO 2013156610 A1 10/2013
WO WO 20130156610 A1 10/2013

(Continued)

OTHER PUBLICATIONS

International Search Report for PCT/US2017/055766; dated Jan. 22, 2018; pp. 1-3.

(Continued)

*Primary Examiner* — Zelalem Eshete
(74) *Attorney, Agent, or Firm* — Mei & Mark, LLP

(57) ABSTRACT

A rocker arm, comprises a first outer arm and a second outer. A pivot body is joined between the first end of the first outer arm and the third end of the second outer arm. An actuatable latch mechanism is within the pivot body. An inner arm assembly comprises a latch arm pivotable adjacent the pivot body. An axle joins the inner arm assembly to pivot between the first outer arm and the second outer arm. An outer arm connector spans between the second end of the first outer arm and the fourth end of the second outer arm. A valve seat insert is constrained within the inner arm assembly between the outer arm connector and the axle. Alternatively, a valve seat insert hangs from the axle and is constrained within the inner arm assembly, the valve seat insert comprising a front and a rear cusp.

30 Claims, 18 Drawing Sheets

Related U.S. Application Data on Aug. 24, 2017, provisional application No. 62/506,469, filed on May 15, 2017, provisional application No. 62/473,864, filed on Mar. 20, 2017, provisional application No. 62/473,890, filed on Mar. 20, 2017, provisional application No. 62/473,918, filed on Mar. 20, 2017, provisional application No. 62/472,388, filed on Mar. 16, 2017, provisional application No. 62/405,690, filed on Oct. 7, 2016.

(51) Int. Cl.

| | |
|---|---|
| ***F01L 1/04*** | (2006.01) |
| ***F01L 1/20*** | (2006.01) |
| ***F01L 1/18*** | (2006.01) |
| ***F01L 1/24*** | (2006.01) |
| ***F01L 1/46*** | (2006.01) |
| ***F01L 13/00*** | (2006.01) |

(52) U.S. Cl.

CPC ..... *F01L 1/2405* (2013.01); *F01L 1/46* (2013.01); *F01L 13/0036* (2013.01); *F01L 2001/186* (2013.01); *F01L 2001/467* (2013.01); *F01L 2003/11* (2013.01); *F01L 2013/001* (2013.01)

(58) Field of Classification Search

CPC ..... F01L 2001/186; F01L 2003/11; F01L 2001/467; F01L 2013/001

See application file for complete search history.

(56) References Cited

U.S. PATENT DOCUMENTS

| | | | |
|---|---|---|---|
| 6,325,030 | B1 | 12/2001 | Spath et al. |
| 6,439,179 | B2 | 8/2002 | Hendriksma et al. |
| 6,481,400 | B2 | 11/2002 | Hendriksma et al. |
| 6,502,536 | B2 | 1/2003 | Lee et al. |
| 6,532,920 | B1 | 3/2003 | Sweetnam et al. |
| 6,604,498 | B2 | 8/2003 | Fernandez et al. |
| 6,901,894 | B2 | 6/2005 | Haas et al. |
| 6,948,466 | B2 | 9/2005 | Haas et al. |
| 7,318,402 | B2 | 1/2008 | Harman et al. |
| 7,377,247 | B2 | 5/2008 | Seitz |
| 7,484,487 | B2 | 2/2009 | Zurface et al. |
| 7,712,443 | B2 | 5/2010 | Gemein |
| 7,798,112 | B2 | 9/2010 | Zurface et al. |
| 7,798,113 | B2 | 9/2010 | Fischer et al. |
| 7,882,814 | B2 | 2/2011 | Spath et al. |
| 28,215,275 | | 7/2012 | Church |
| 8,251,032 | B2 | 8/2012 | Manther |
| 8,327,750 | B2 | 12/2012 | Keller et al. |
| 8,534,182 | B2 | 9/2013 | Keller et al. |
| 8,607,753 | B2 | 12/2013 | Krause et al. |
| 8,635,980 | B2 | 1/2014 | Church |
| 8,726,862 | B2 | 5/2014 | Zurface et al. |
| 8,752,513 | B2 | 6/2014 | Zurface et al. |
| 8,783,219 | B2 | 7/2014 | Gunnel et al. |
| 8,915,225 | B2 | 12/2014 | Zurface et al. |
| 8,985,074 | B2 | 3/2015 | Zurface et al. |
| 9,016,252 | B2 | 4/2015 | Zurface et al. |
| 9,038,586 | B2 | 5/2015 | Schultheis et al. |
| 9,140,148 | B2 | 9/2015 | Church |
| 9,194,260 | B2 | 11/2015 | Zurface |
| 9,194,261 | B2 | 11/2015 | McCarthy, Jr. |
| 9,228,454 | B2 | 1/2016 | VanDeusen |
| 9,267,396 | B2 | 2/2016 | Zurface et al. |
| 9,284,859 | B2 | 3/2016 | Nielse et al. |
| 9,291,075 | B2 | 3/2016 | Zurface et al. |
| 9,470,116 | B2 | 10/2016 | Cecur |
| 9,581,058 | B2 | 2/2017 | Radulescu et al. |
| 9,644,503 | B2 | 5/2017 | Zurface et al. |
| 9,664,075 | B2 | 5/2017 | McCarthy, Jr. |
| 9,702,279 | B2 | 7/2017 | Zurface et al. |
| 9,708,942 | B2 | 7/2017 | Zurface et al. |
| 9,726,052 | B2 | 8/2017 | Zurface et al. |
| 9,765,657 | B2 | 9/2017 | VanDeusen |
| 9,790,823 | B2 | 10/2017 | Zurface |
| 10,253,657 | B2 | 4/2019 | Uckermark et al. |
| 2001/0023675 | A1 | 9/2001 | Lee et al. |
| 2001/0027765 | A1 | 10/2001 | Hendriksma et al. |
| 2002/0011225 | A1 | 1/2002 | Hendriksma et al. |
| 2004/0035381 | A1 | 2/2004 | Burch et al. |
| 2004/0237919 | A1 | 12/2004 | Haas et al. |
| 2005/0132989 | A1 | 6/2005 | Hendriksma |
| 2005/0132990 | A1 | 6/2005 | Haas et al. |
| 2006/0157008 | A1 | 7/2006 | Lechner et al. |
| 2007/0101958 | A1 | 5/2007 | Seitz |
| 2007/0113809 | A1 | 5/2007 | Harman et al. |
| 2007/0186890 | A1 | 8/2007 | Zurface et al. |
| 2007/0283914 | A1 | 12/2007 | Zurface et al. |
| 2009/0217895 | A1 | 9/2009 | Spath et al. |
| 2010/0018482 | A1 | 1/2010 | Keller et al. |
| 2010/0319657 | A1 | 12/2010 | Dodi et al. |
| 2011/0226208 | A1 | 9/2011 | Zurface et al. |
| 2011/0226209 | A1 | 9/2011 | Zurface et al. |
| 2012/0037107 | A1 | 2/2012 | Church |
| 2012/0260875 | A1 | 10/2012 | Moeck et al. |
| 2013/0000582 | A1 | 1/2013 | Church |
| 2013/0068182 | A1 | 3/2013 | Keller et al. |
| 2013/0146008 | A1 | 6/2013 | Stoody |
| 2013/0220250 | A1 | 8/2013 | Gunnel et al. |
| 2013/0233265 | A1 | 9/2013 | Zurface et al. |
| 2013/0255612 | A1 | 10/2013 | Zurface et al. |
| 2013/0306013 | A1 | 11/2013 | Zurface et al. |
| 2013/0312506 | A1 | 11/2013 | Nielsen et al. |
| 2013/0312681 | A1 | 11/2013 | Schultheis et al. |
| 2013/0312686 | A1 | 11/2013 | Zurface et al. |
| 2013/0312687 | A1 | 11/2013 | Zurface et al. |
| 2013/0312688 | A1 | 11/2013 | VanDeusen |
| 2013/0312689 | A1 | 11/2013 | Zurface et al. |
| 2014/0041608 | A1 | 2/2014 | Zurface |
| 2014/0150745 | A1 | 6/2014 | Church |
| 2014/0190431 | A1 | 7/2014 | McCarthy, Jr. |
| 2014/0283768 | A1 | 9/2014 | Keller et al. |
| 2015/0128890 | A1 | 5/2015 | Cecur |
| 2015/0211394 | A1 | 7/2015 | Zurface et al. |
| 2015/0267574 | A1 | 9/2015 | Radulescu et al. |
| 2015/0369095 | A1 | 12/2015 | Spoor et al. |
| 2015/0371793 | A1 | 12/2015 | Sheren et al. |
| 2015/0377093 | A1 | 12/2015 | Church |
| 2016/0061067 | A1 | 3/2016 | Schultheis et al. |
| 2016/0061068 | A1 | 3/2016 | Zurface |
| 2016/0084117 | A1 | 3/2016 | Zurface et al. |
| 2016/0108766 | A1 | 4/2016 | Zurface et al. |
| 2016/0115831 | A1 | 4/2016 | Spoor et al. |
| 2016/0130991 | A1 | 5/2016 | Zurface et al. |
| 2016/0138435 | A1 | 5/2016 | Zurface et al. |
| 2016/0138438 | A1 | 5/2016 | Genise et al. |
| 2016/0138484 | A1 | 5/2016 | Nielsen et al. |
| 2016/0146064 | A1 | 5/2016 | Spoor et al. |
| 2016/0169065 | A1 | 6/2016 | VanDeusen |
| 2016/0230619 | A1 | 8/2016 | McCarthy, Jr. |
| 2016/0273413 | A1 | 9/2016 | Sheren et al. |
| 2017/0002698 | A1 | 1/2017 | Cecur |
| 2017/0248073 | A1 | 8/2017 | McCarthy, Jr. |
| 2018/0320603 | A1 | 11/2018 | Vance et al. |
| 2019/0284971 | A1 | 9/2019 | Vance et al. |
| 2019/0309659 | A1 | 10/2019 | Vance |
| 2019/0309660 | A1 | 10/2019 | Vance |

FOREIGN PATENT DOCUMENTS

| | | | |
|---|---|---|---|
| WO | WO 2014134601 | A1 | 9/2014 |
| WO | WO 2014134601 | A9 | 9/2014 |
| WO | WO 2016155978 | A1 | 10/2016 |
| WO | 2017024249 | A1 | 2/2017 |
| WO | 2018068041 | A1 | 4/2018 |

(56) References Cited

FOREIGN PATENT DOCUMENTS

| | | | |
|---|---|---|---|
| WO | 2018068043 | A1 | 4/2018 |
| WO | 2018068046 | A1 | 4/2018 |

OTHER PUBLICATIONS

Written Opinion for PCT/US2017/055766 dated Jan. 22, 2018; pp. 1-18.
International Search Report for PCT/US2016/045842 dated Oct. 28, 2016; pp. 1-5.
Written Opinion for PCT/US2016/045842 dated Oct. 28, 2016 pp. 1-18.
International Search Report for PCT/US2017/055777 dated Jan. 24, 2018; pp. 1-4.
Written Opinion for PCT/US2017/055777 dated Jan. 24, 2018; pp. 1-19.
International Search Report for PCT/US2017/055788; dated Jan. 24, 2018; pp. 1-4.
Written Opinion for PCT/US2017/055788 dated Jan. 24, 2018; pp. 1-13.
International Search Report for PCT/US2017/055785 dated Jan. 17, 2018; pp. 1-7.
Written Opinion for PCT/US2017/055785 dated Jan. 17, 2018; pp. 1-11.

*FIG.1C* *(Prior Art)*

SELF-CONTAINED E-FOOT

This is a § 371 National Stage Entry of Patent Cooperation Treaty Application No. PCT/US2017/055785, filed Oct. 9, 2017, and claims the benefit of U.S. provisional application No. 62/405,690, filed Oct. 7, 2016, 62/472,388 filed Mar. 16, 2017, 62/473,918 filed Mar. 20, 2017, 62/473,890 filed Mar. 20, 2017, 62/473,864 filed Mar. 20, 2017, 62/506,469 filed May 15, 2017, 62/549,471 filed Aug. 24, 2017, and 62/554,909 filed Sep. 6, 2017, all of which are incorporated herein by reference.

FIELD

This application provides a rocker arm for a valvetrain comprising an e-foot over the valve side.

BACKGROUND

Biasing a rocker arm and its components against an affiliated actuator is difficult due to packaging constraints. And, tailoring a rocker arm for myriad possible lift profiles is difficult to design for, as the moving parts are prone to interfere with one another. In the prior art example of FIG. 1A, a through-axle 1 passes through rollers 2, outer arms 3, inner arms 4, and a roller axle 6. Roller axle 6 supports a roller 7. Springs bias the hollow roller axle 6 in one direction so that when a latch mechanism is latched, an exhaust valve can have the exhaust valve profile shown in FIG. 1B, or an intake valve can have the intake valve profile shown in FIG. 1C. When unlatched, the IEGR (internal exhaust gas recirculation) on exhaust valve profile can be achieved in FIG. 1B, or the late intake closing (LIVC) profile can be achieved in FIG. 1C. The motion differences between the latched and unlatched profiles are sufficient for some purposes, but the through-axle is restrictive for accomplishing other purposes.

SUMMARY

The methods and devices disclosed herein overcome the above disadvantages and improves the art by way of a rocker arm, comprising a first outer arm comprising a first inner side, a first outer side, a first end, and a second end, and a second outer arm comprising a second inner side, a second outer side, a third end, and a fourth end. A pivot body is joined between the first end of the first outer arm and the third end of the second outer arm. An outer arm connector spans between the second end of the first outer arm and the fourth end of the second outer arm. An actuatable latch mechanism is within the pivot body. An inner arm assembly comprises a latch arm pivotable adjacent the pivot body. An axle joins the inner arm assembly to pivot between the first outer arm and the second outer arm. A valve seat insert is constrained within the inner arm assembly between the outer arm connector and the axle.

Alternatively, a rocker arm, comprises a first outer arm comprising a first inner side and a first outer side, and a second outer arm comprising a second inner side and a second outer side. A pivot body is joined between the first inner side and the second inner side. An actuatable latch mechanism is within the pivot body. An inner arm assembly comprises a latch arm pivotable adjacent the pivot body. An axle joins the inner arm assembly to pivot between the first outer arm and the second outer arm. A valve seat insert is constrained within the inner arm assembly, the valve seat insert comprising a front cusp configured to encircle a portion of the axle and a rear cusp configured to encircle a second portion of the axle, wherein the valve seat insert can hang from the axle via the front cusp and the rear cusp.

A valvetrain can comprise a rocker arm. The valvetrain can comprise first, second, and third rotating cam lobes, where the first cam lobe is configured to press upon the first outer arm, where the second cam lobe is configured to press upon the second outer arm, and, wherein the third cam lobe is configured to selectively push the inner arm assembly to rotate past the actuatable latch mechanism when the actuatable latch mechanism is in an unlatched position. The inner arm assembly can be biased by a spring force towards the third cam lobe.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

BRIEF DESCRIPTION OF THE DRAWINGS

FIGS. 1B & 1C are views of prior art valve lift profiles for the through-axle rocker arm.

DETAILED DESCRIPTION

Reference will now be made in detail to the examples which are illustrated in the accompanying drawings. Wherever possible, the same reference numbers will be used throughout the drawings to refer to the same or like parts.

Figure 1A:
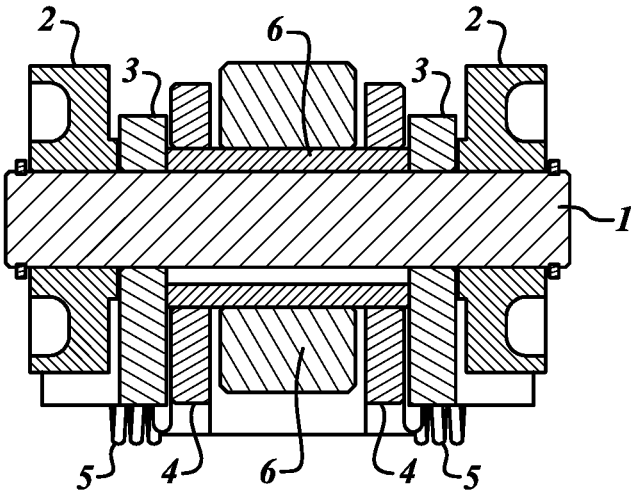
FIG.1A (Prior Art)
FIG. 1A is a cross-section view of a prior art through-axle rocker arm.
Figure 1B:
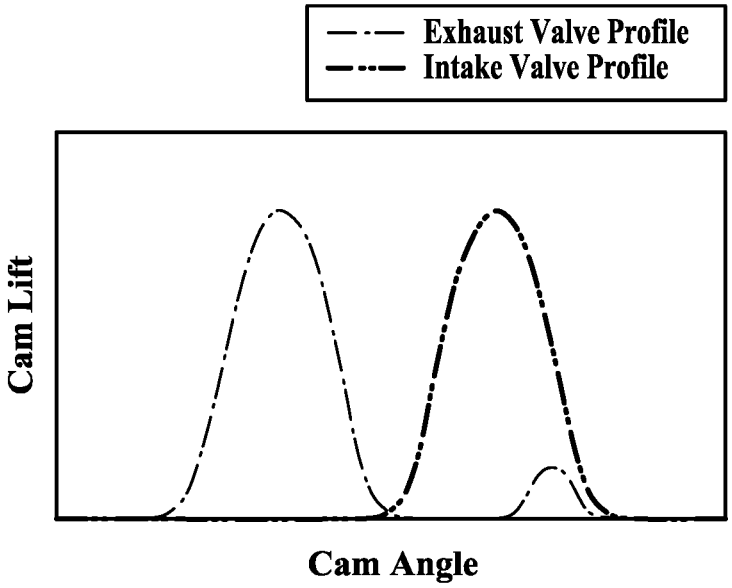
FIG.1B (Prior Art)

Rocker arms are subject to high actuation rates during valve lift and lowering. It is desired to provide increased lost motion and to enable early intake valve closing and other variable valve actuation, such as cylinder deactivation. However, prior art switching rolling finger follower (SRFF) designs are constrained to low lift events or high loss events, but cannot provide a range of lift events. FIG. 1A shows a prior art SRFF with limited range on the variable valve lift (VVL) events, corresponding to US 2015/0128890. A regular exhaust valve profile and a regular intake valve profile can be achieved utilizing the SRFF of FIG. 1A. Using a latch, the SRFF can be switched to provide internal exhaust gas recirculation (IEGR) as in FIG. 1B or late intake valve closing (LIVC) profile as in FIG. 1C. But in FIG. 1A, a center through-axle 1 restricts the motion of the example SRFF. By eliminating the through-axle 1, a greater range of motion can be achieved.

Figure 2A:
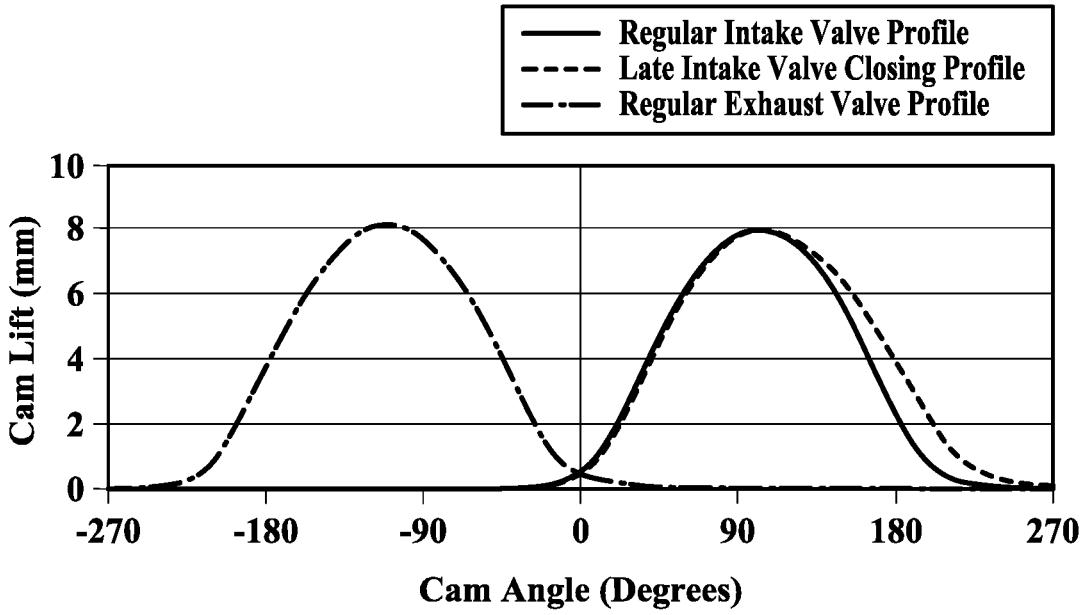
FIGS. 2A & 2B are views of valve lift profiles that can be achieved in addition to the prior art valve lift profiles when using the instant disclosure.
Figure 2A:
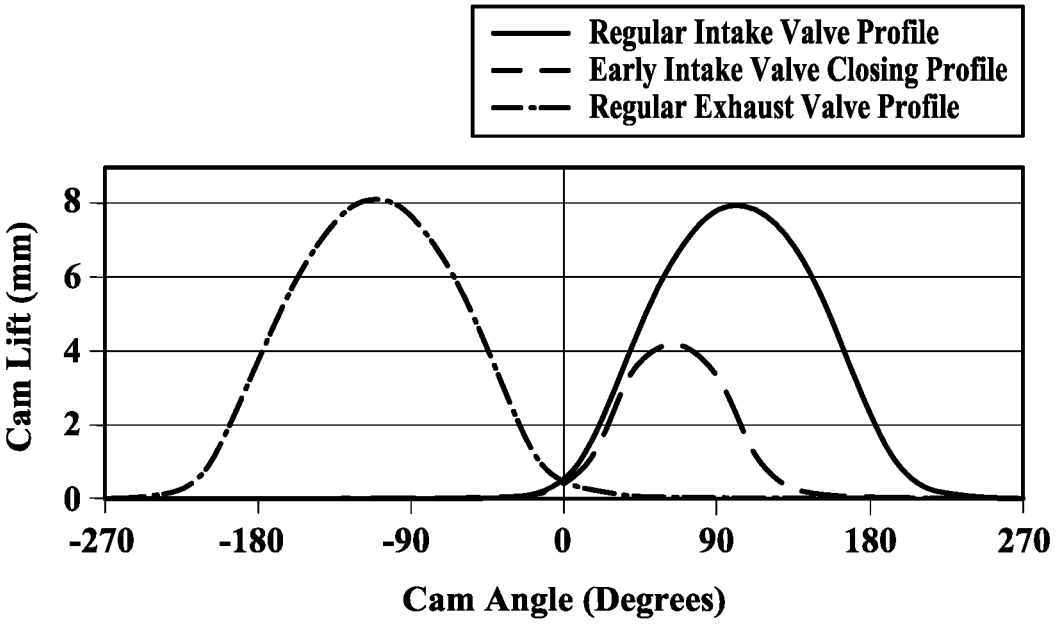

For example, the early intake valve closing (EIVC) profile of FIG. 2A can be achieved utilizing the SRFFs disclosed herein. Three eccentric cam lobes, two outer lobes 1001 & 1002 and an inner lobe 1003, can rotate on a cam rail 1000 of a type II engine valvetrain. Actuators for the SRFF can comprise electro-mechanical latches or cam lobes. The rocker arm can be mounted in a type II overhead cam valvetrain having one or more cam rails. Or, other actuation rails can be implemented for a cam/cam less system having some cam operations and some operations without cams. Each roller 400, 410, 310 of the rocker arm (SRFF) can correspond to a cam lobe or other actuator.

Figure 12A:
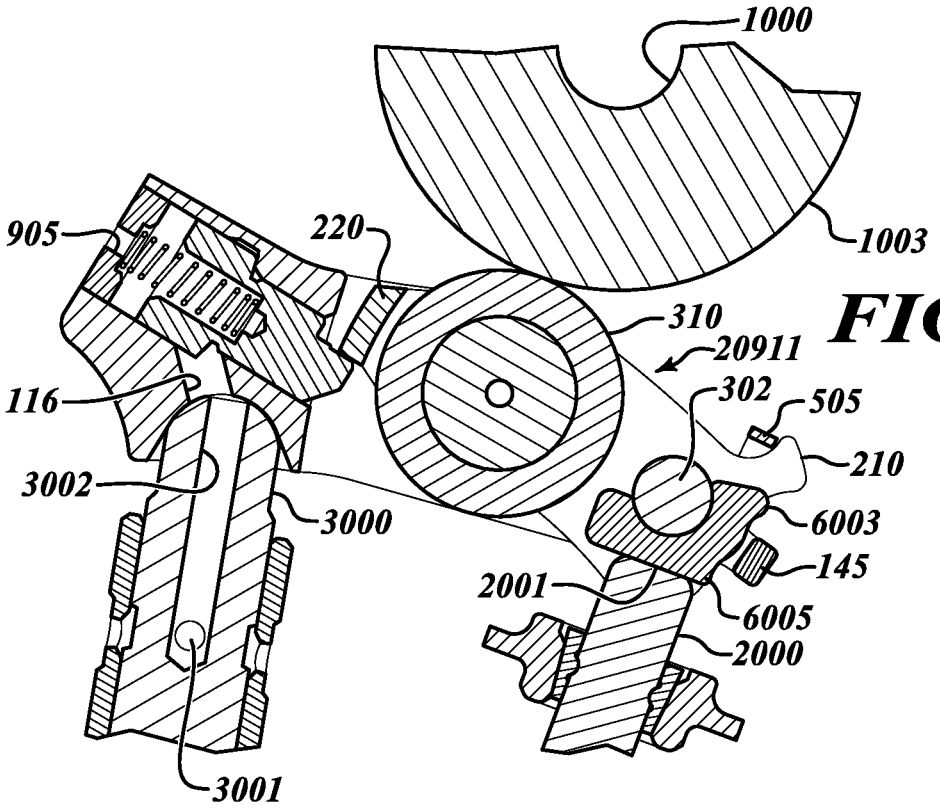
FIGS. 12A & 12B contrast a rocker arm in a valvetrain at base circle and at full actuation of the inner arm assembly.

The shapes of the cam lobes 1001, 1002, 1003 determine the motion of the SRFF as a latch mechanism 900 within the pivot body 111 is selectively actuated. As seen in FIG. 12A, a rocker arm latched while the cam 1003 is at base circle can result in a valve being closed. But, controlling hydraulic fluid through a hydraulic lash adjuster (HLA) 3000, as via fluid ports 3001, 3002 can actuate latch mechanism 900, retract latch finger 906, and permit inner arm assembly 20911 to swing down when the peak of the eccentric portion of the cam lobe 1003 presses against roller 310. HLA or like mechanism can connect the SRFF to an engine block on the pivot end 11 of the SRFF. Additionally or alternatively, a push rod can be coupled to the HLA 3000. A valve end 12 of the SRFF can comprise a valve seat in the form of a valve pallet 112, or one of the alternatives herein or the like, for mounting a valve stem end 2001 of a valve so that the valve head 2003 can be opened and closed to provide the desired valve profile. For example, when the SRFF is latched, a high lift profile, shown in FIG. 2B, can be achieved. The inner cam lobe 1003 can be designed with a larger cam lift (in millimeters) than the outer lobes 1001, 1002. The eccentricity of the lobes can be designed so that as the cam lobes rotate (shown as cam angle in degrees) off their base circle, the valve head 2003 can open and close with one or more of different timing, duration and extent. So in FIG. 2B, the outer lobes 1001, 1002 are designed with a smaller cam lift than the inner lobe 1003. With the SRFF unlatched, the inner lobe 1003 pushes on the inner roller 310 linked to inner arms 200, 210 and the outer lobes 1001, 1002 push on the outer rollers 400, 410 to result in a low lift profile. A delta profile shows the difference between the high and low lift profiles. The height of the delta profile can be correlated to the relative motion of the inner arm of the SRFF and can indicate the lost motion travel of the inner arm. The lift events can be significantly higher for the high lift event than for prior work. Approximately 30% more lift can be achieved using the disclosed arrangements. And, the same SRFF can be used to achieve the lift profiles of the prior art devices, such as FIGS. 1B & 1C, as by pairing the disclosed SRFFs with appropriate cam lobe pairings.

Figure 2B:
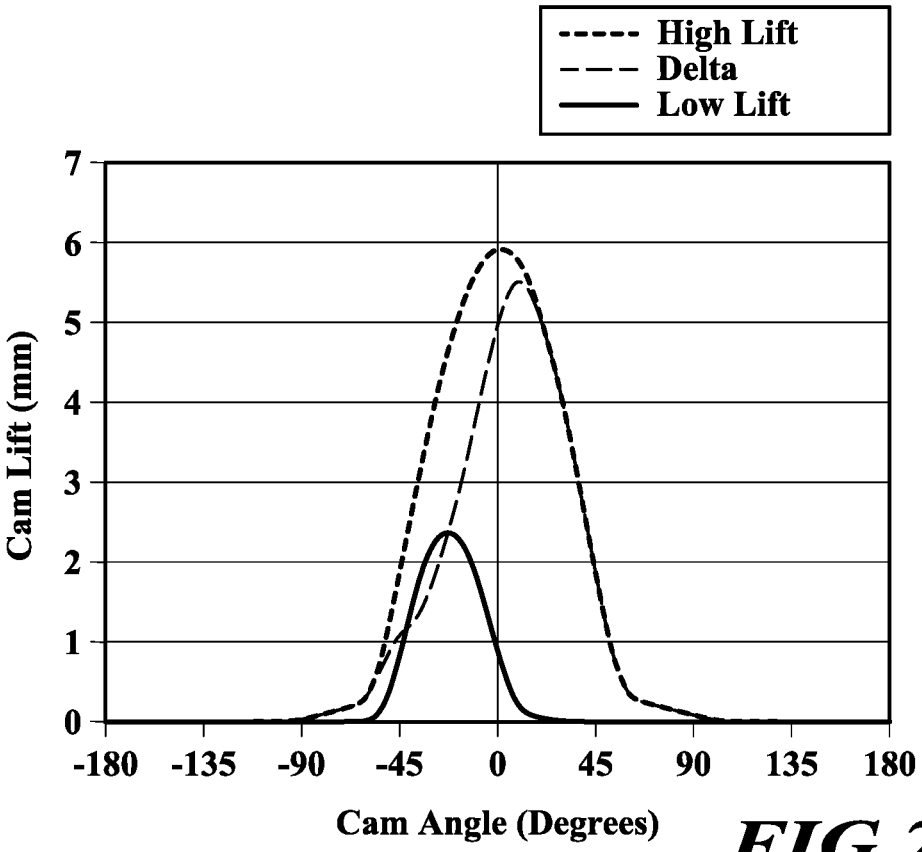
Figure 3:
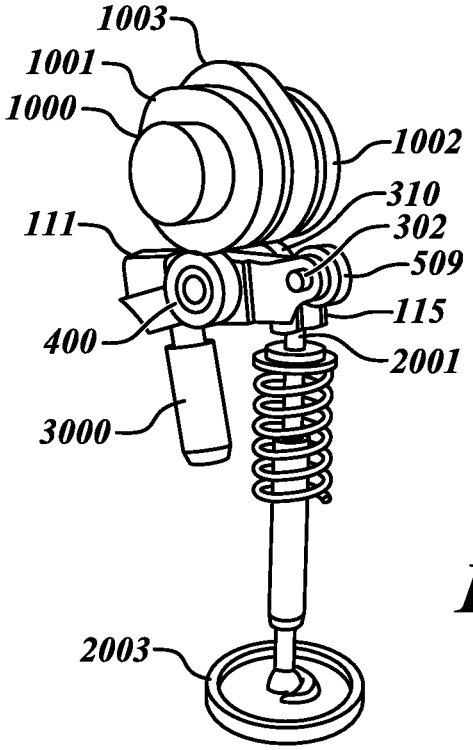
FIG. 3 shows a portion of a valve actuation system.

FIGS. 2A & 2B are example lift profiles. Other lift profiles are possible and have not been drawn exhaustively. The rocker arm can comprise three rollers 400, 410, 310. Two outer rollers 400, 410 are mounted in a cantilever fashion outboard on the rocker arm to rotate on posts 123, 133 on the outer arms.

The third roller (inner roller) 310 can be mounted on an independent bearing axle, such as second axle 300, between the inner arms 220, 230. The inner arms 220, 230 can pivot on a pivot axle, such as first axle 302. The pivot axle can connect the inner arm assembly 209 to distal ends of the outer arms 120, 130. First axle 302, as pivot axle, can also connect the at least one biasing mechanism, center spring 509, to the rocker arm.

When the inner arm assembly 209 pivots on the pivot axle, "lost motion" is said to occur, and the inner arms 200, 210 can pivot to permit variable valve lift events from zero valve lift (full cylinder deactivation, or full lift loss) through to some amount less than full lift. Alternatively, the inner arms can be latched via a latch seat to permit a high lift event, greater than a normal lift event, while a normal lift event takes place on the rollers of the outer arms.

This enables techniques such as cylinder deactivation (CDA) (valve closure) and early or late valve techniques, including negative valve overlap (NVO), early or late intake valve opening or closing (EIVC, LIVC, EIVO, LIVO), or early or late exhaust valve opening or closing (EEVO, EEVC, LEVO, LEVC).

So, it is possible to design the SRFF, sometimes called a rocker arm, for either variable valve lift events or for cylinder deactivation (CDA). In a first engine operating mode, inner cam lobe 1003 presses on an inner roller 310 housed between inner arms 200, 210 of the rocker arm. A latch is biased or actuated to catch against a latch seat linked to the inner arms so that the cam lob pushes both inner arms 200, 210 and outer arms 120, 130 of a main body 110 of the rocker arm. This yields a first lift height for an affiliated valve. Then, during a second engine operating mode, the latch can be moved away from the latch seat to allow the inner arms 200, 210 to pivot when the inner cam lobe 1003 presses on the inner roller 310. The lift height of the inner cam lobe can be "lost," because it is not transferred to the valve. Outer cam lobes 1001, 1002 can press on the outer arms 120, 130 of the rocker arm to accomplish a second lift height. The second lift height can be from zero to some amount less than the first lift height.

Turning to the first exemplary SRFF in FIGS. 4A-4G, there is no longer a through-axle 1 spanning through three rollers 2, 7. The middle, or inner roller 310, can now be a single shear material, instead of a dual layer material. The sleeved design on the inner roller of FIG. 1A can be eliminated. The outer rollers 400, 410 are cantilevered from the SRFF main body, and instead of sliding the through axle 1 through the outer arms, as in FIG. 1A, the outer rollers 400, 410 can be mounted on cantilevered posts 123, 133 that are integrally formed with the outer arms 120, 130. By using rollers 400, 410, 310 instead of slider pads, there are less friction losses. By cantilevering the outer rollers 400, 410 to the SRFF main body, large lift events can be accommodated. An inner arm assembly 209 can move independently of the outer arms 120, 130. The inner arm assembly 209 can comprise inner arms 200, 210, latch arm 220, and an inner roller 310, among additional features and alternatives outlined below.

FIGS. 4A-4G show alternative views of an SRFF having a lost motion spring 509 over the valve end of the main body 110 and cantilevered outer rollers 400, 410. The latch mechanism 900 for the center lost motion mechanism is in-line with the main profile of the SRFF. The in-line shape can be understood by looking at the planar cross-section of FIG. 4D, where the in-line shape is the result of a co-planar relationship of the first axle 302 (pivot axle) that joins the inner arms 220, 230 to the outer arms 120, 130, the bearing (or second) axle 300, and the main axis of the latch mechanism 900.

The center spring 509 is over the valve end of the rocker arm. A valve stem end 2001 can be mounted to abut second side 114 of valve pallet 112. Valve guides 115 can be formed on the valve pallet 112 in the form of projections that guide the valve stem end 2001 as the SRFF rocks during actuation. The valve guides can be hooked or cleated to retain the valve stem end 2001. The valve guides 115 limit the ability of the valve stem end 2001 to move from side to side against the valve pallet 112, while not restricting the ability of the valve stem end to slide front to back along the valve pallet second side 114. That is, the valve stem 2000 can move slightly in directions parallel to the long axis A-A of the SRFF, but is restricted from moving perpendicular to the long axis of the SRFF. Meanwhile, an hydraulic lash adjuster (HLA) 3000 can be mounted in a ball-and-socket type arrangement in HLA seat 117 to cooperate with hydraulic port 116.

The center spring can be biased in several ways. For example, a first end 5001 of the center spring 509 can be biased against a spring prop in the form of an inner bar 204. A second end 5002 of the center spring 509 can be biased against first side 113 of valve pallet 112. Alternative biasing techniques will be discussed below.

The latch mechanism 900 is in a latched position in FIGS. 4A-4D. The center spring biases the inner arm assembly 209 so that inner roller 310 is lifted towards the inner cam lobe 1003 when the SRFF is installed in a valve train. This can also mean that the latch arm 220 is biased to a position above a surface of latch assembly 900, such as above latch seat 901. So, the latch arm 220 of the inner arm 200 can be in contact with the latch seat 901 when the inner arm assembly 209 is pressed from above, or the latch arm 220 it can be biased to a position slightly above the latch seat 901.

Figure 4A:
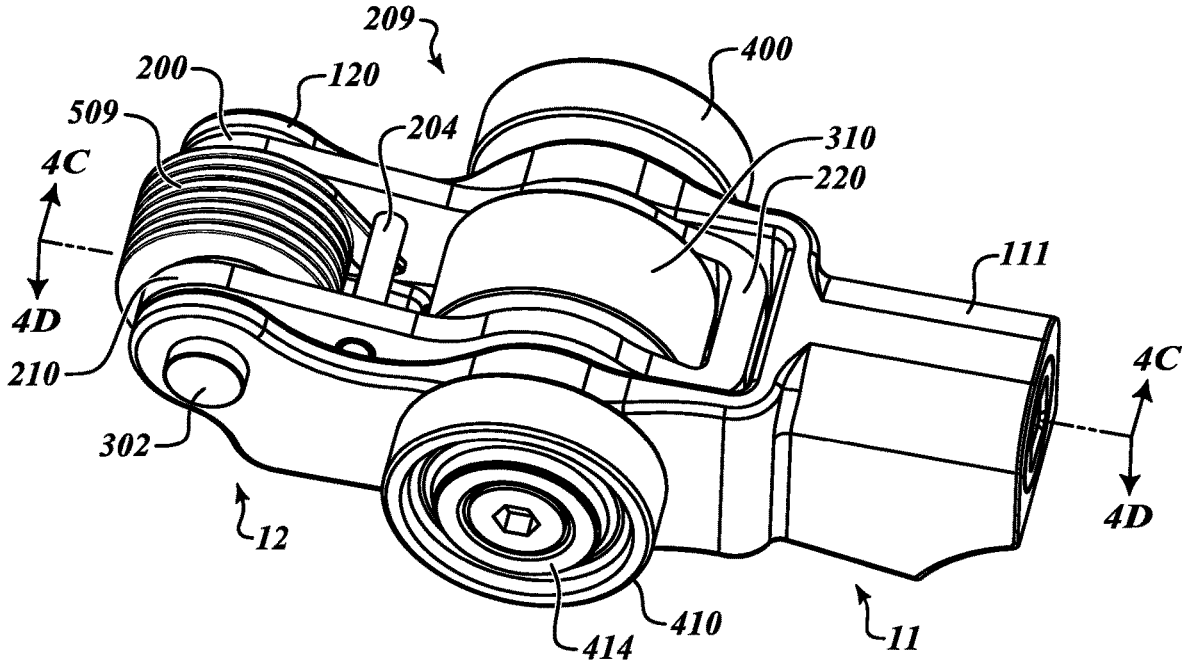
FIGS. 4A-4G show alternative rocker arm views comprising an inner spring.
Figure 4B:
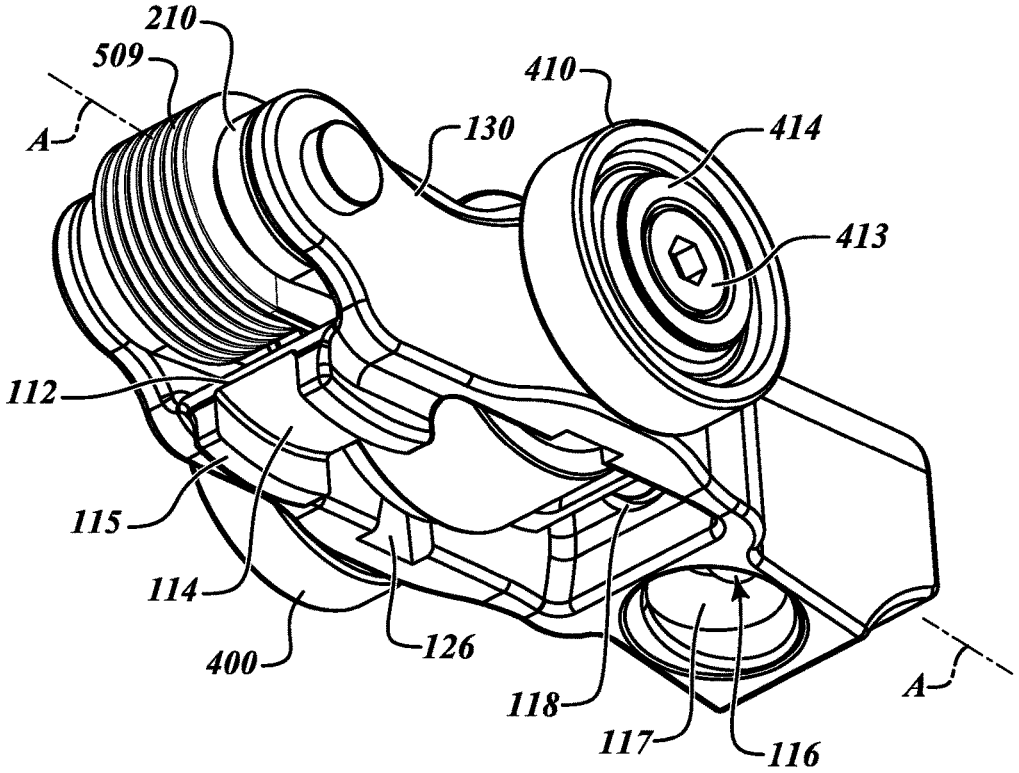
Figure 4C:
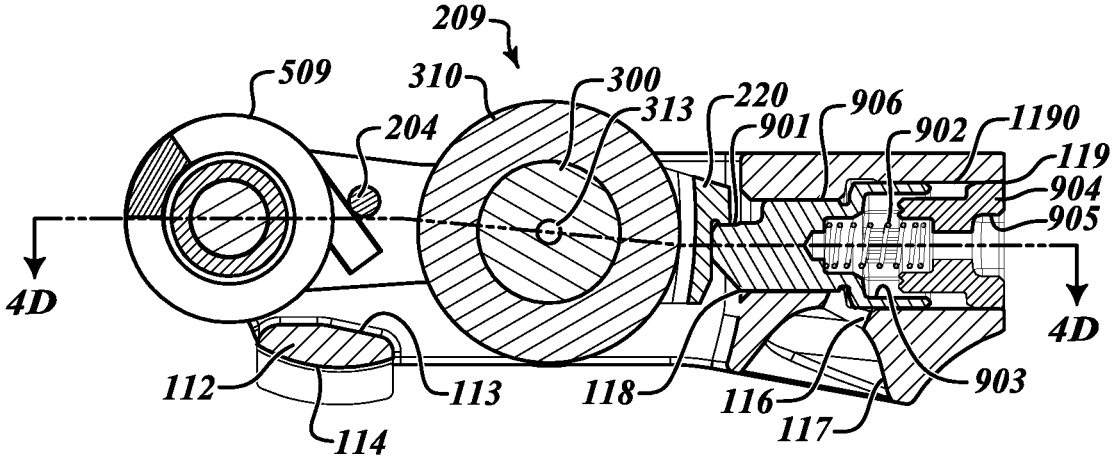
Figure 4D:
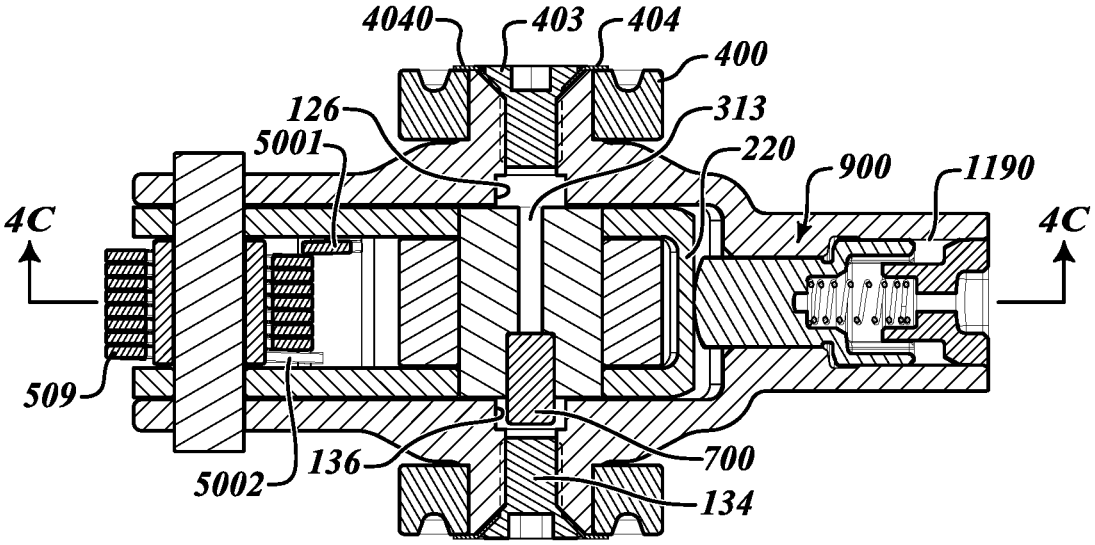
Figure 4E:
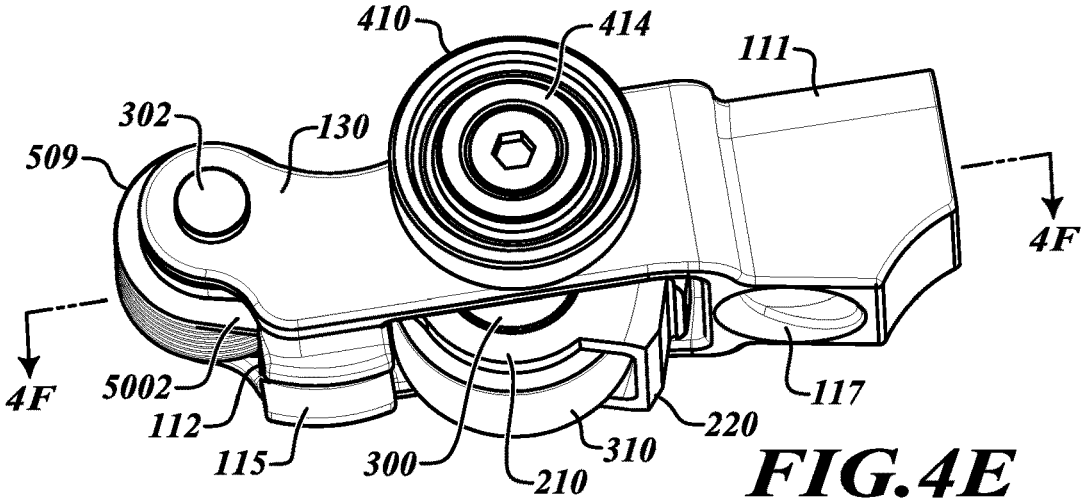
Figure 4F:
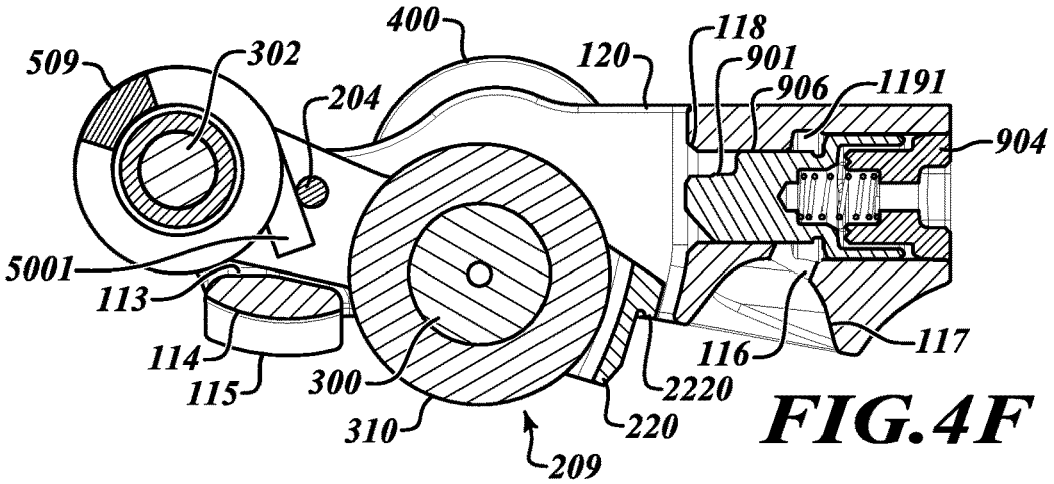

In FIGS. 4E & 4F, the latch mechanism 900 is in an unlatched position and latch arm 220 has rotated past the latch to "lose" the motion of the center cam lobe 1003 on the inner arm assembly 209. Outer cam lobes 1001, 1002 can roll on the outer first and second rollers 400, 410.

The latch mechanism 900 can be actuated by hydraulics, and thus be connected to oil control valves and an oil control circuit. Or, electric or electro-mechanical mechanisms can reciprocate a latch. The latch can be biased to operate in a default position or require affirmative control for each of the first or second positions (extended or withdrawn positions).

In the example of FIGS. 4A-4F, a hydraulic latch is shown for the latch mechanism 900. A latch finger 906 can reciprocate so that a latch seat 901 can extend from and retract in to an inner latch port 118 in the pivot body 111 of the SRFF. The latch finger 906 can fluidly communicate with hydraulic port 116 so that fluid can be fed through the HLA 3000 or through a latch fluid port 905, or a fluid circuit can be established therethrough. Latch port 118 in stepped, as is the latch finger 906 so that a shoulder can fill a portion 1190 of latch cavity when the latch finger 906 is extended, and the shoulder can fill another portion 1191 of latch cavity with latch finger 906 is retracted. Latch plug 904 can receive and bias a latch spring 902 that can bias the latch finger 906 to the extended position. As above, other latch mechanisms can be substituted for the hydraulic latch illustrated without departing from the SRFF operation principles described herein.

FIGS. 4C & 4D illustrate additional aspects. The inner roller 310 can be a unitary material, or it can comprise a separate bearing axle or second axle 300 fixed across the inner arms 220, 230 and an outer material, as illustrated. In some embodiments, the bearing axle 300 can be surrounded by bearings, such as ball or needle bearings 312, and the outer material serves as an outer race and a bearing surface for interfacing with cam lobe 1003. Either way, a hollow passageway 313 can be formed within the inner roller 310. The hollow passageway can permit light-weighting or other weight control techniques. When combined with below aspects, the hollow passageway can be used with an alignment tool to set the placement of a pump-down stop, such as pin 700.

FIGS. 4E & 4F illustrate the SRFF in an unlatched condition. The latch finger 906 is in a retracted position, and a shoulder of the latch finger is withdrawn to permit fluid in the other cavity 1191 of the stepped inner latch port 118. As above, the central spring 509 is biased between spring prop 204 and first side of valve pallet 113. But, an inner cam lobe 1003 can overcome the spring force of central spring 509. Latch arm 220 can swing past the latch mechanism 900 as inner arm assembly 209 pivots on first axle 302, but the inner arms 200, 210 cannot swing past valve pallet 112. because the inner arms can come in to contact with the first side 113 of the valve pallet 112. So, the extent of inner arm assembly 209 travel can be restricted by a pump-down stop, such as pins 700, 701, 703, in a first direction and the valve pallet 112 in a second direction.

While the example of FIGS. 4A-4G show an in-line latch, other examples show an alternative design having an angled latch mechanism 900 for the center lost motion mechanism (inner arm assembly 209). The angled latch can comprise the pivot axle (first axle 302) and the inner arm first axle 300 in-line in a plane (intersected by a plane), and the latch mechanism 900 can be angled away from the plane (the latch mechanism 900 can be in an intersecting plane). In FIGS. 4A-4G, the lost motion spring is inside the main body of the SRFF, and the lost motion spring biases the inner roller 310 towards the cam rail 1000. The lost motion spring 509 is positioned over the valve. But in the other examples, the lost motion spring, or springs, are in different locations, but continue to bias the inner roller 310 towards the cam rail 1000 or towards a position above the latch finger 906.

Pivot-Side Lost Motion Springs

In FIGS. 6A-6E, another alternative is shown with the lost motion springs over the pivot end 11 of the SRFF. Inner arm assembly 2096 can comprise inner arms 200, 210, latch arm 220, and inner roller 310. Inner roller can be between inner arms 200, 210 and can comprise a portion of the bearing axle 300 extending out through the inner arms 200, 210 towards the outer arms 120, 130. The lost motion springs are over the hydraulic lash adjuster (HLA) 3000 or pushrod and is not over the valve end 12 in this embodiment. So, there is less weight over the valve, which increases beneficial valvetrain dynamics. The valve operation is more optimal. Also, instead of a single lost motion spring in the center of the SRFF, two lost motion springs flank the latch mechanism 900.

The lost motion springs are pivot side springs 5010, 5020 mounted to spring posts 1131, 1141 on pivot body 111 on the pivot end of the rocker arm. A spring bushing 5040 can be pressed to each spring post 1131, 1141 to secure pivot side springs 5010, 5020 in place. Main body 110 can comprise first and second ledges, such as pivot ledges 1111, 1121, for biasing first spring arm ends 5011, 5013. Second spring arm ends 5021, 5023 can be biased against bearing axle 300 (which can be integrally formed with inner roller 310). Bearing axle 300 can extend out from inner arms 220, 230 to catch against the second spring arm ends 5021, 5023.

The arrangement permits straight arms on the spring for the spring arm ends 5011, 5013, 5021, 5023. Also, the "kidney bin" of prior designs, where the bearing axle previously passed through the outer arms and restricted the extent of inner arm travel, is eliminated. Outer arm can comprise bends 1201, 1301 in the outer arms 120, 130 while the inner arms 210, 220 are straight. Additional alternatives can be understood viewing the pump-down stops, and the arrangement of FIGS. 6A-6E can comprise the pin 700, 701, 703 arrangements of FIGS. 4G & 5A-5E with provisions for catching the second spring arm ends 5021, 5023.

With the lost motion springs on the pivot end of the SRFF, the inertia is reduced over the valve, and valve actuation can be quicker. Additional light-weighting on the valve side can inure from removing spring prop 204.

Figure 6A:
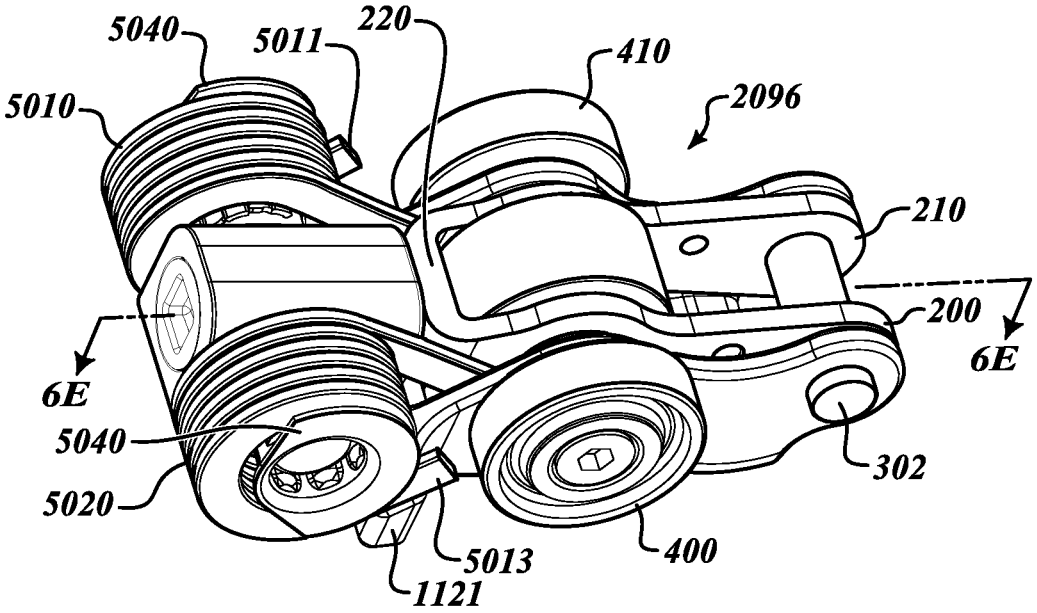
FIGS. 6A-6E show alternative rocker arm views comprising springs on the pivot end.
Figure 6B:
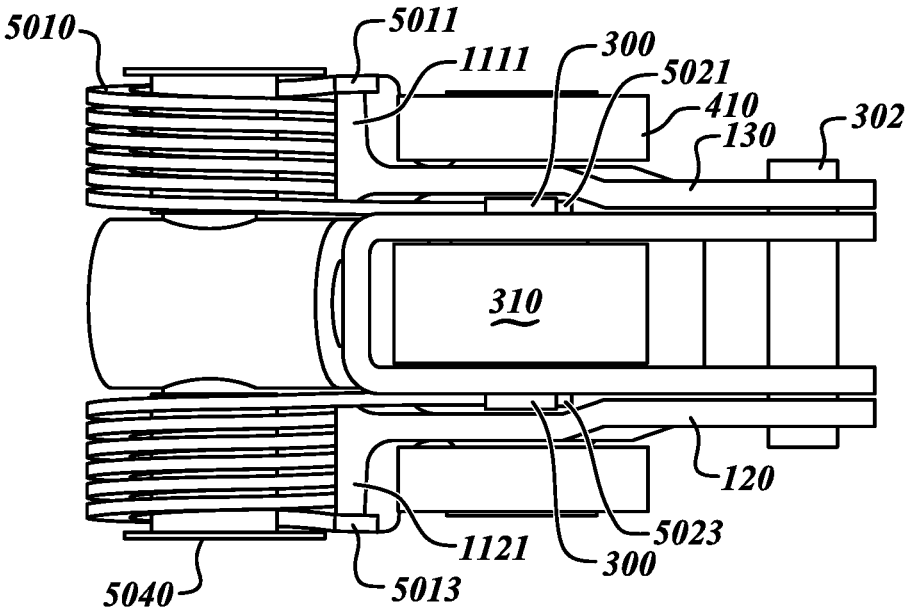
Figure 6C:
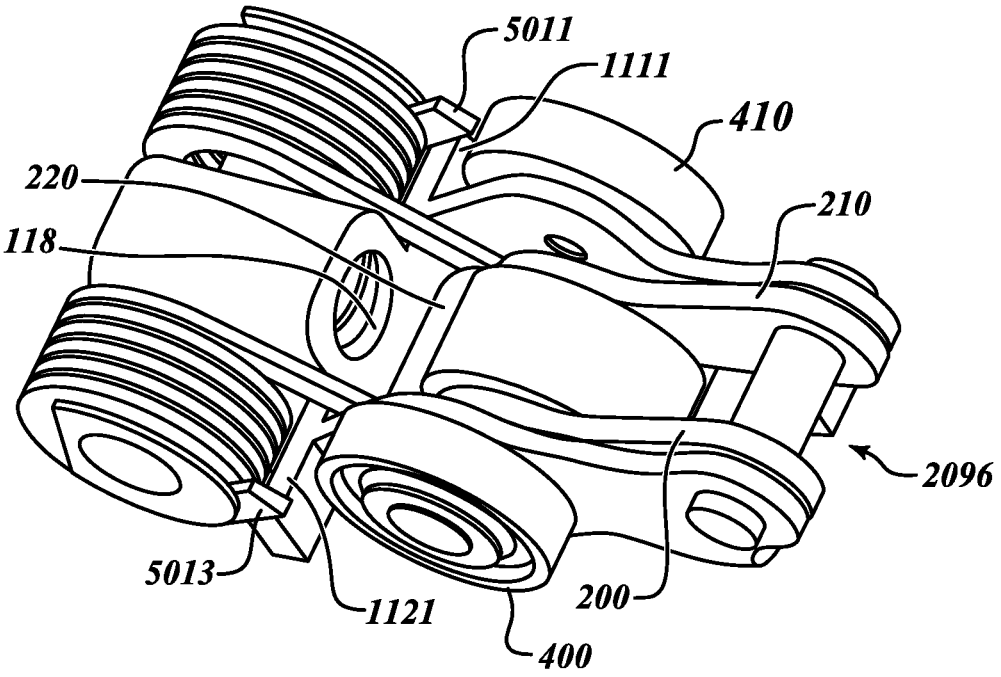
Figure 6D:
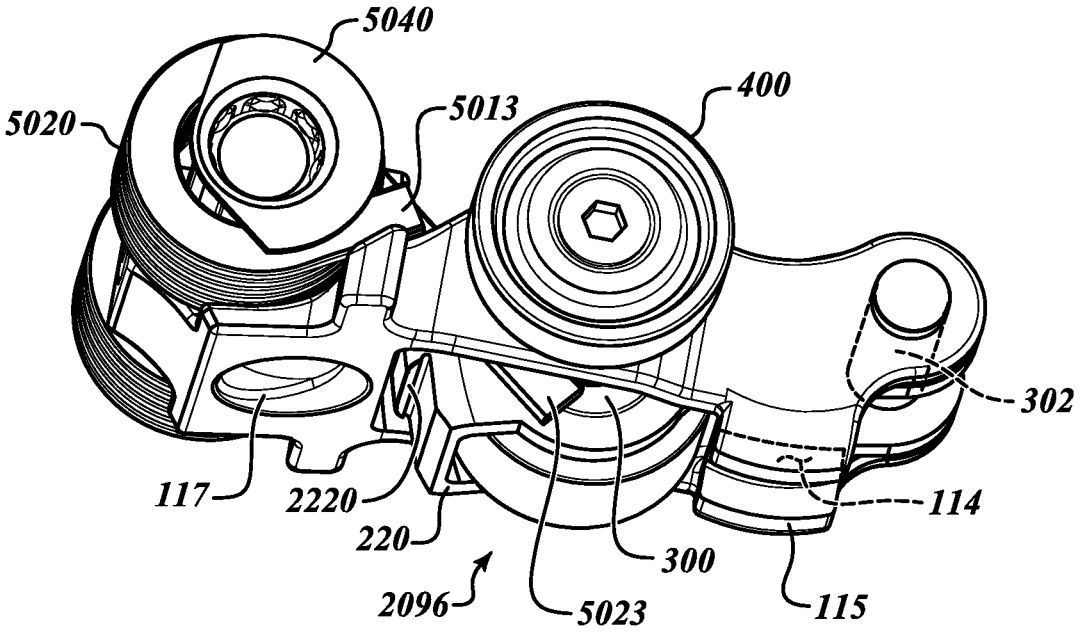
Figure 6E:
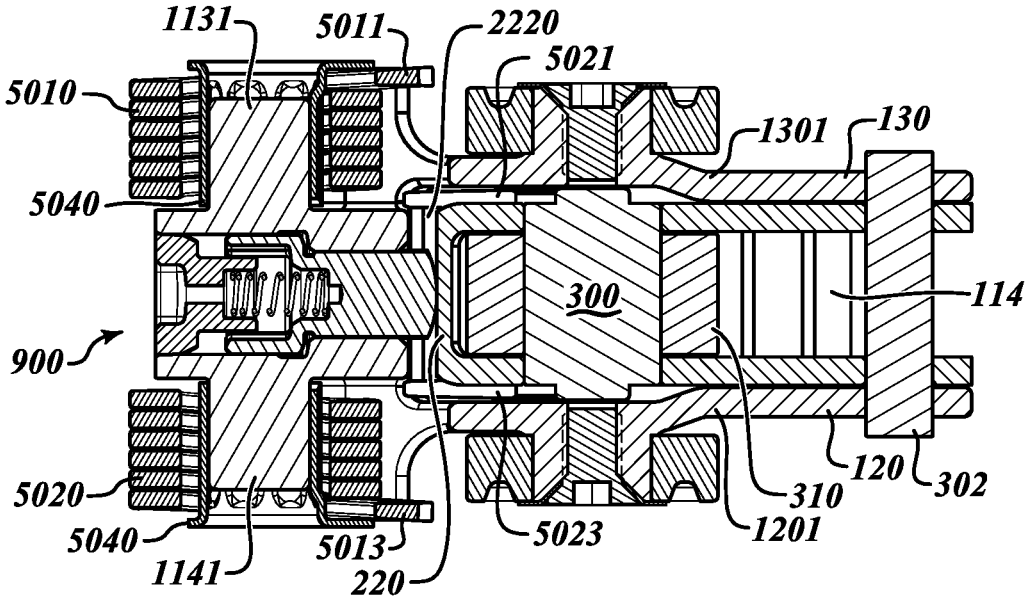

In FIGS. 6A, 6B, & 6E, the rocker arm is shown in a latched position, while FIGS. 6C & 6D show the inner arm pivoted away from the latch mechanism while in the unlatched position. The travel of the inner arm assembly 209 can be limited as by one of travel limit techniques herein, such as the pump-down stop techniques below or such as being restricted by the valve pallet 112, as above.

Also, the spring-over-pivot side configuration of FIGS. 6A-6E can be in-line, as in FIG. 6E, such that a plane can intersect each of the first axle (pivot axle) 302, the bearing axle 300, and the long axis of the latch mechanism 900. Or, an angled-latch configuration can be used, such that a first plane can intersect each of the first axle (pivot axle) 302 and the bearing axle (second axle) 300 while the long axis of the latch mechanism 900 is in a separate plane that intersects the first plane.

A rocker arm for a valve train can thus comprise a main body 110 comprising a pivot end 11 and a valve end 12. Outboard sides 121, 131 can constitute a first side and a second side. A first post 123 can be connected to the first side 121 as by being integrally formed with the first side, and the first post 123 can extend away from the first side 121. A second post 133 can be connected to the second side and can extend away from the second side oppositely from the first post 123. First roller 400 can be connected to rotate on the first post 123 and second roller 410 can be connected to rotate on the second post 133. First and second posts 123, 133 can be cantilevered from the outboard sides 121, 131.

A latch mechanism 900 can be within the pivot end 11 of the main body 110. Latch mechanism 900 can comprise a latch finger 906 configured to selectively move between a latched position, wherein the latch finger 906 extends towards the valve end 12, and an unlatched position, wherein the latch finger 906 withdraws away from the valve end 12. The latch finger 906 can comprise a latch surface 901.

Latch arm 220 of inner arm assembly 209 can pivot from the valve end 12 between the first side and the second side from a position above the latch surface 901 to a position below the latch surface 901. Inner arm assembly 209 can comprise an axle 300 and a third roller, inner roller 310, rotatable on the axle 300. Latch arm 209 can be configured to latch against the latch surface 901 when the latch finger 906 is in the latched position and configured to rotate past the latch surface 901 when the latch finger 906 is in the unlatched position.

Additional alternatives exist for biasing the latch arm of the inner arm to a position above the latch seat 901 of the latch finger 906. Biased in this direction, the inner roller 310 can follow the cam lobe 1003 for actuation in a valvetrain.

Outboard Lost Motion Springs

Turning to FIGS. 7A-9B, alternative out-board spring designs are proposed, where the springs are mounted on the valve end 12 of the rocker arm. By switching from the inner coil spring 509 to the out-board alternatives, the springs 506, 507, 5060, 5070 can be mounted outboard on the rocker arm to avoid interference with the sweep of the inner cam lobe 1003.

In FIGS. 7A-7F, alternative one-piece torsion springs are shown. Ends of the alternative springs react against the out-board sides 121, 131 of the outer arms 120, 130, and the alternative springs also react against extensions on the inner arms 200, 210. In FIGS. 8A-9B, two springs 5060, 5070 are used with alternative arrangements for ends reacting against the outer (outboard) sides 121, 131 of the outer arms and for reacting ends against alternative extensions on the inner arms.

The rocker arm can comprise a first spring ledge 129 and a second spring ledge 139. Ledges 129, 139 can be longitudinally positioned between the pivot axle 302 and the first (inner) roller 310 or outer rollers 400, 410. The spring 500 can be mounted on the first axle 302. The spring 500 can be biased against the ledges 129, 139. The one-piece spring 500 of FIGS. 7A-7F can comprise a first spring 506 mounted on the first outer side 121 and a second spring 507 mounted on the second outer side 131. The first spring 506 and second spring 507 can be torsion springs with tangential spring ends extending at approximately 90 degrees. A lateral connector 505 can connect the first spring 506 to the second spring 507. The first spring 506, the second spring 507, and the lateral connector 505 can be integrally formed to make the one-piece spring 500. First spring 506 can comprise a ledge end 501 abutting the ledge 129, and the second spring 507 can comprise a ledge end 502 abutting ledge 139.

Lateral connector 505 can react against (be biased by) extensions on the inner arms 200, 210, such as respective hooked spring props 201, 211. A first spring prop 201 on the first inner arm 200 is distal from the latch arm 220. A second spring prop 211 on the second inner arm 210 distal from the latch arm 220. When cam lobe 1003 pivots the inner arm assembly 209, the lateral connector 505 is pressed by the spring props 201, 211 and the force is transferred into the coils of springs 506, 507. The inner arm assembly 209 can swing to permit lost motion, as in FIG. 7E. With the valve pallet 12 removed, the amount of lost motion possible with the SRFFs of FIGS. 7A-7F is greater than the prior embodiment. Also, the stresses of contacting the valve pallet 112 is removed from the SRFF and valvetrain system.

Figure 7A:
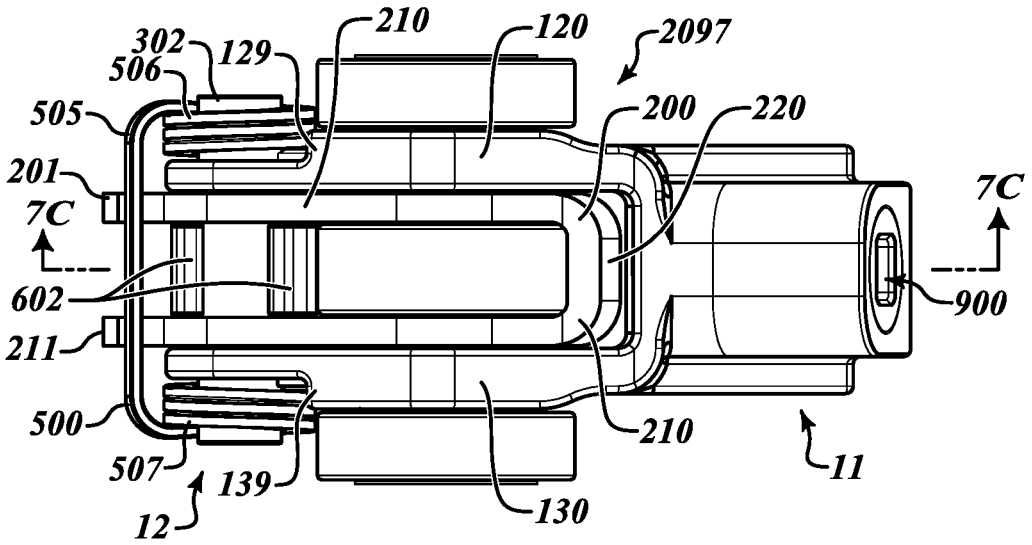
FIGS. 7A-7F show alternative rocker arm views comprising outboard springs on the valve end.
Figure 7B:
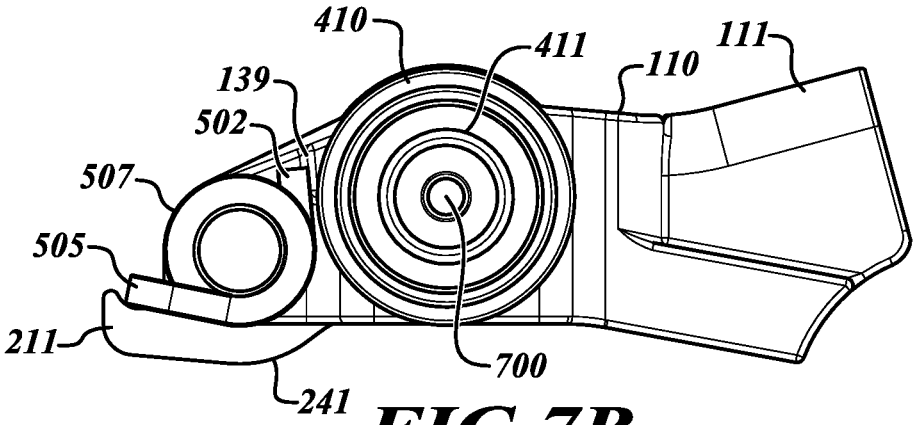
Figure 7C:
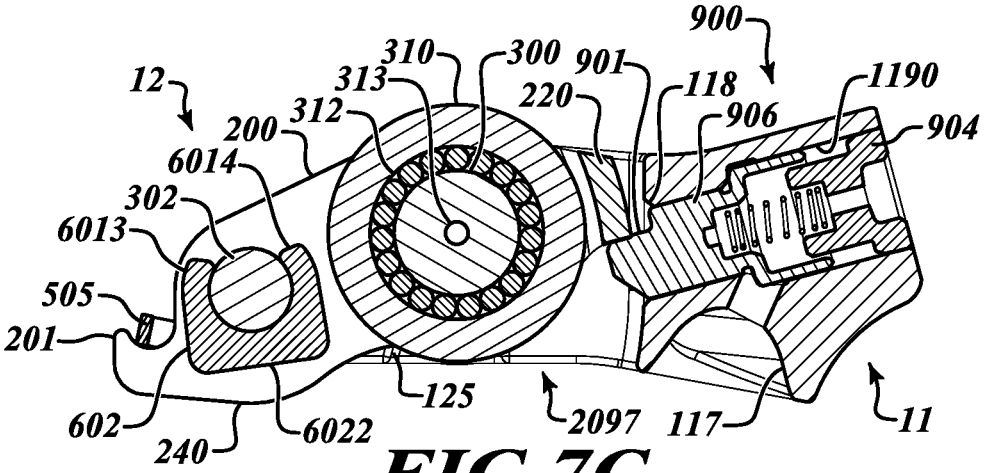
Figure 7D:
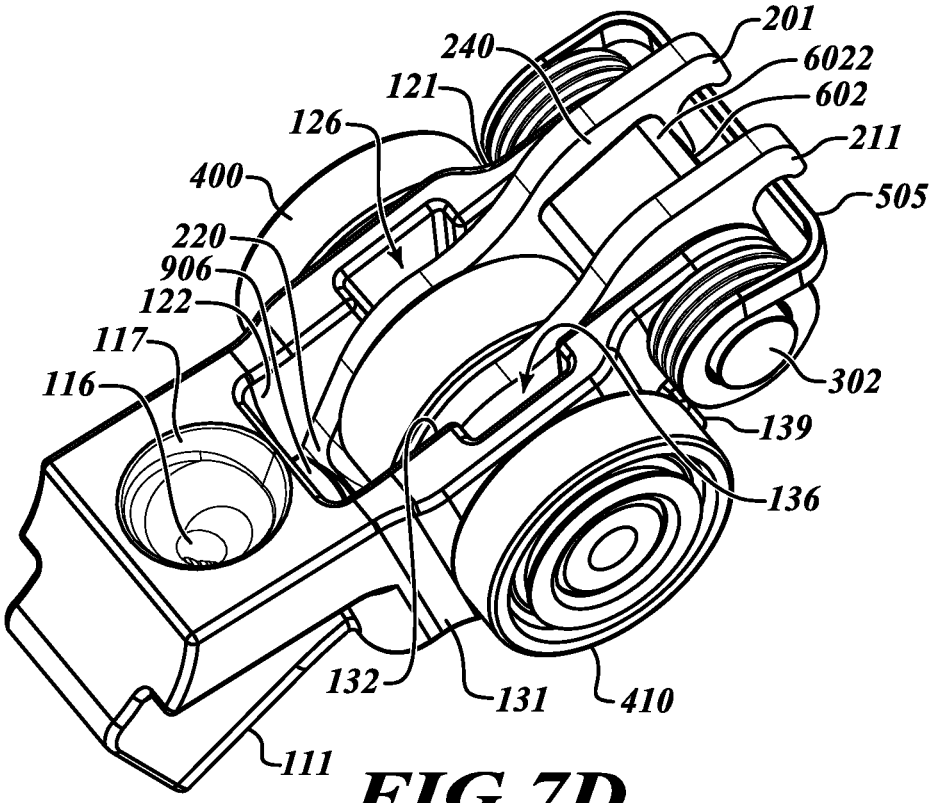
Figure 7E:
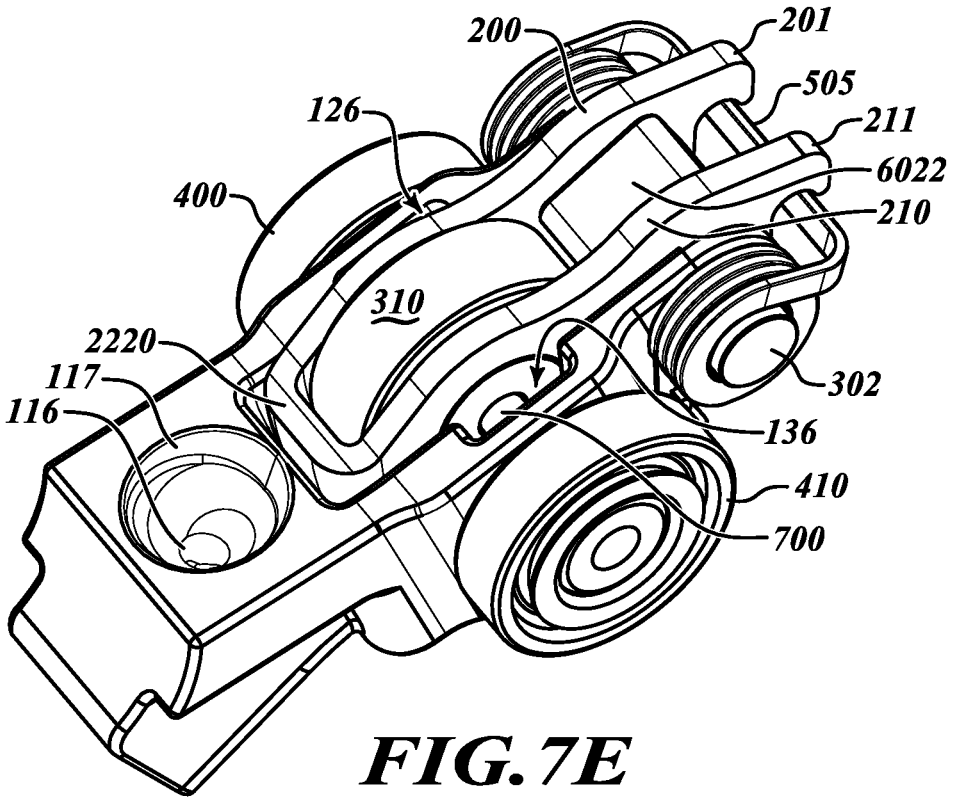

As the cam lobe 1003 rotates from an eccentric edge pressing the inner roller 310 to base circle pressing the inner roller, the springs 506, 507 uncoil, transferring force against the first and second spring ledges 129, 139 and against the spring props 201, 211 to once again bias the inner arm assembly 209 towards the latched condition, with the latch arm 220 above the latch seat 901, as in FIGS. 7C & 7D.

Hooked spring props 201, 211 can be integrally formed with inner arms 200, 210 and can comprise additional material for guiding the valve stem end 2001, such that a valve pallet 112 is no longer necessary. Scallop-shaped inner arm valve guides 240, 241 can be formed on the inner arms 200, 210 to flank the valve stem end 2001. Side-to-side motion of the valve stem end 2001 is thus restricted, though a small amount of sliding is permitted along the long axis of the SRFF, on the crown of the valve seat insert. Then, a variety of valve seat inserts 600, 601, 602 can be accommodated, commensurate with the below teachings. By appropriately securing the inner arms 200, 210 between the outer arms 120, 130, the inner arms 200, 210 can exert a clamp force on one or both the valve stem end 2001 and the valve seat insert to hold the items in place. The shared use of the pivot axle 302 over the valve end 12 promotes efficient use of parts, unifying the outer arms, inner arms, and valve seat insert with the single operation of inserting the pivot axle. It is further possible to unify the outer arms, inner arm, valve seat insert, and springs 506, 507 with the single operation of inserting the pivot axle 302.

Alternative rocker arms are shown in FIGS. 8A-8D. These Figures comprise separate springs 5060, 5070 mounted to the pivot axle 302. Springs 5060 & 5070 can be torsion springs with tangential spring ends extending at approximately 90 degrees. The slim design permits straight inner arms 200, 210 within substantially straight outer arms 120, 130 for a tight footprint. And, the latch assembly 900 can be laterally restricted to fit between the outboard (outer) sides 121, 131 of the outer arms 120, 130 for a slim design. Latch arm 220 can pivot between outer arms 120, 130 as above.

Figure 8A:
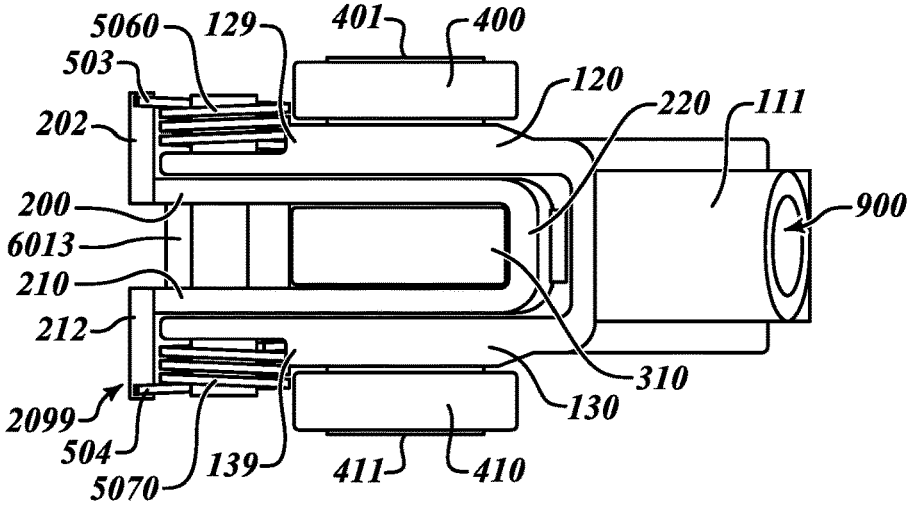
FIGS. 8A-8D show alternative rocker arm views comprising outboard springs on the valve end.
Figure 8B:
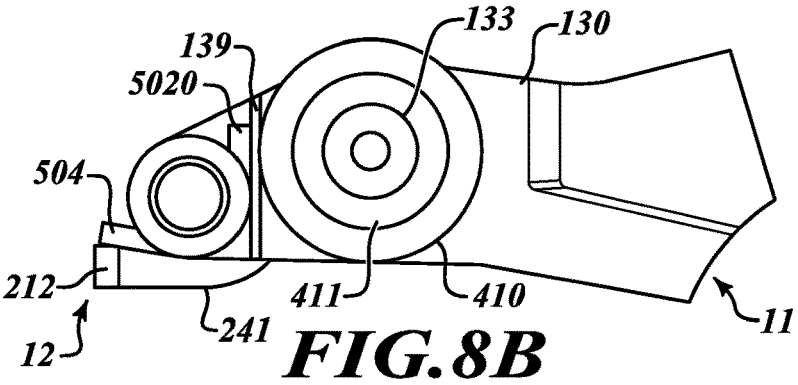
Figure 8C:
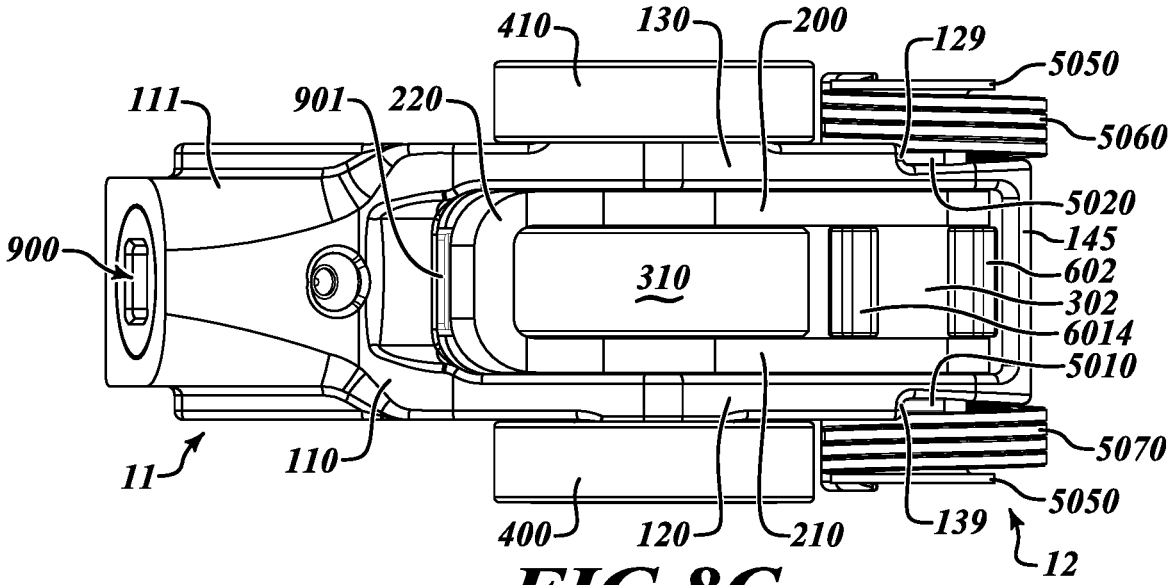

The top views of FIGS. 7A, 8A & 8C show that the springs 506 & 507 or 5060 & 5070 need not extend laterally past the outer rollers 400, 410. The outer (outboard) sides 121, 131 of the outer arms can be stepped to provide a recess or pocket for the springs 5060, 5070. Such a recess or pocket can also be provided above for springs 506, 507. The springs can then recede laterally in to the rocker arm, and seat with spring ends 501, 502 or 5010, 5020 pressed against ledges 129, 139. Ledges 129, 139 can form a surface of the recess or pocket and be part of the stepped shape of the outer sides 121, 131. Ledges 129, 139 can be longitudinally positioned between the pivot axle 302 and the rollers 310, 400, 410.

In FIGS. 8A & 8B, inner arm assembly 2099 can comprise inner arms 200, 210 with forward spring props 202, 212, latch arm 220, and inner roller 310. Spring ends 503, 504 react against laterally extending spring props 202, 212 while spring ends 5010, 5020 react against ledges 129, 139 on the outer sides 121, 131 of outer arms 120, 130. In FIGS. 8A & 8B, the laterally extending spring props 202, 212 extend out from the inner arms 200, 210 and the spring props 202, 212 are in front of the valve seat insert 602. First spring prop 202 on the first inner arm 200 is distal from the latch arm 220. Second spring prop 212 on the second inner arm 210 is distal from the latch arm 220. The spring props 202, 212 are the most distal aspects on the valve end 12. The spring props 202, 212 can extend so that they protrude from between the outer arms 120, 130. Inner arm valve guides 240, 241 can be included to function as above, and the lateral spring props 202, 212 can protrude therefrom.

Figure 8D:
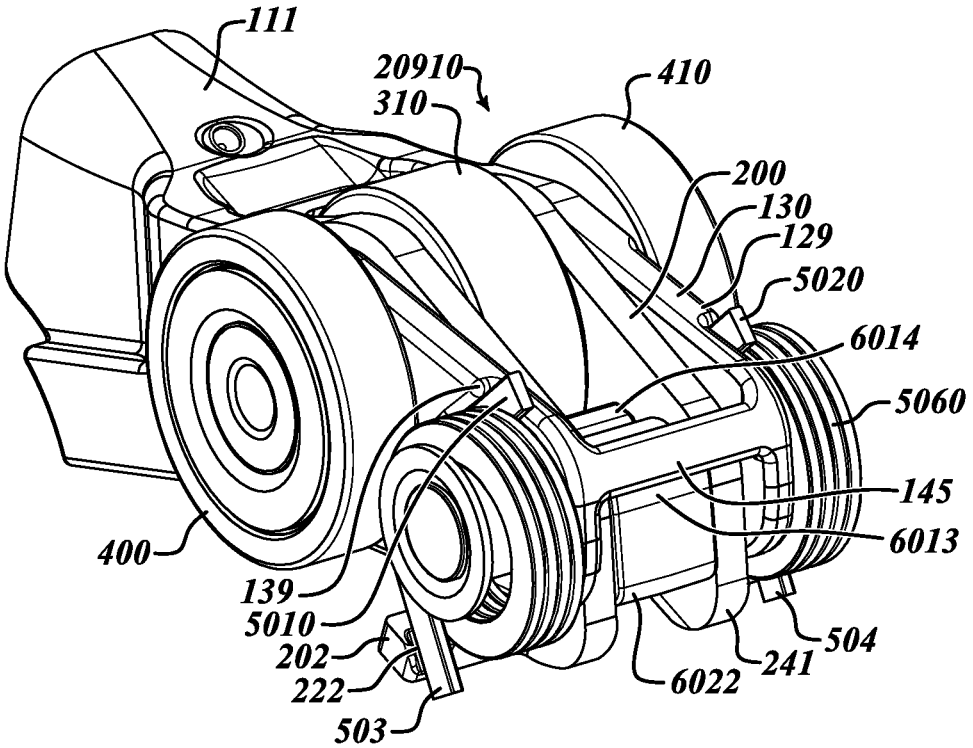

In FIGS. 8C & 8D, springs 5060, 5070 are rotated from the position shown in FIGS. 8A & 8B, and so are the angles of the ledges 129, 139 and the positions of the spring props 202, 212. Inner arm assembly 20910 can comprise inner arms 200, 210 with alternative spring prop locations, latch arm 220, and inner roller 310. The laterally extending spring props 202, 212 can be behind the valve seat insert 602 or can intersect a plane passing through the valve seat insert. The spring props 202, 212 can still be considered distal from the latch arm 220. It is possible for the spring prop 202, 212 to be in-line with the pivot axle 302. Or, the spring prop 202, 212 can be more centrally located (proximal to the center to the rocker arm). The spring props 202, 212 are shown with notches 222 for seating the spring ends 503, 504. Again, the spring props 202, 212 can extend so that they protrude from between the outer arms 120, 130. Inner arm valve guides 240, 241 can be included to function as above, and the lateral spring props 202, 212 can protrude therefrom. The FIGS. 8C & 8D embodiment can result in the lateral spring props 202, 212 being used as an inner arm assembly travel stop should the inner arm assembly 209 rotate enough to cause contact between the spring props 202, 212 and the outer arms 120, 130. In FIGS. 8C & 8D, an outer arm connector 145 can be included on the valve ends of the outer arms to provide stability.

Figure 9A:
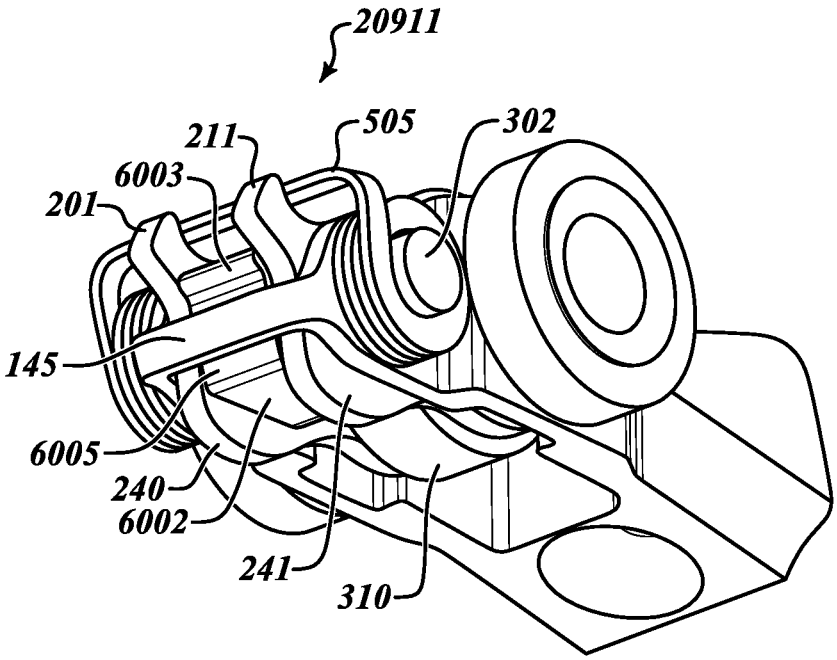
FIGS. 9A & 9B show alternative rocker arm views comprising outboard springs on the valve end and an alternative travel stop.
Figure 9B:
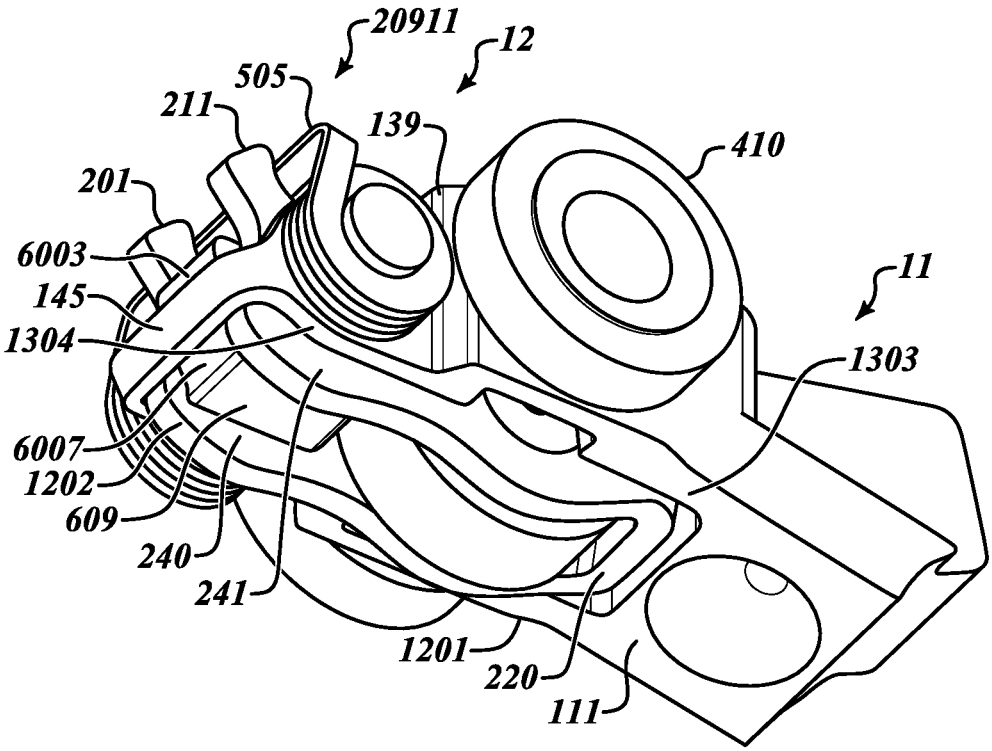

Another example of providing a travel stop on the outer arms 120, 130 can be seen in FIGS. 9A & 9B. Inner arm assembly 20911 can comprise inner arms 200, 210 with hooked spring props 201, 211, latch arm 220, and inner roller 310. An outer arm connector 145 can comprise a piece of material extending from one or both of the outer arms towards the other of the outer arms. The outer arm connector can lend structural stability when integrally formed with or integratively connected to the outer arms 120, 130. When in the latched condition, the inner arm assembly 209 is restricted from pivoting too far in the direction of the cam rail 1000, and latch arm 220 can only travel so far in the direction above latch seat 901 because the spring props, here hooked spring props 201, 211 contact the outer arm connector 145. One-piece spring 500 biases the spring props 201, 211 in the direction of the outer arm connector 145. Inner arm valve guides 240, 241 can be appropriately shaped to rotate between the outer arms 120, 130 and outer arm connector 145. In the unlatched condition, the spring props 201, 211 travel away from the outer arm connector 145.

Figure 12B:
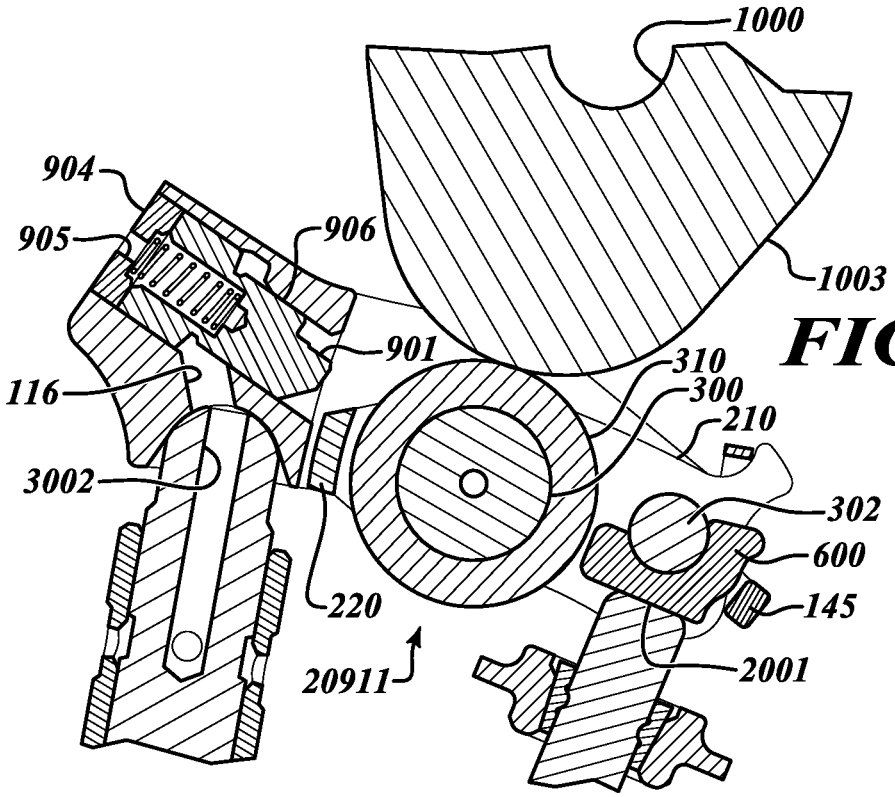

In FIGS. 12A & 12B, the outer arm connector 145 can provide alternative functionality. In FIG. 12A, in the latched condition, the valve seat insert 600 is "basketed" by the outer arm connector 145 to be within the rocker arm and prevented from falling out. In FIG. 12B, the outer arm connector 145 abuts the inner arm valve guide 240 to provide a travel stop for the inner arm assembly 20911.

Valve Seat Inserts

An additional aspect of the outer arm connector 145 can be understood with respect to the valve seat insert 600 (sometimes called an e-foot or elephant foot). In this embodiment, the valve seat insert 600 can comprise an "L" shaped. The outer arm connector 145 can offer a travel limit to the valve seat insert 600 as by providing a ledge against which an upper lip 6003 can catch against. Valve seat insert 600 can be squeezed by inner arms 200, 210, and can be molded to conform to at least a portion of pivot axle 302. The inner arm valve guides 240, 241 can flank the valve surface 6002 to provide, collectively, a seat for the valve stem end 2001. In some instances hooks, cleats or steps can be included on the inner arm valve guides 240, 241, similar to valve guides 115, to secure the valve stem end 2001. Valve seat insert can be inserted between the lost motion springs 506, 507 to add cross section stiffness.

Figure 11:
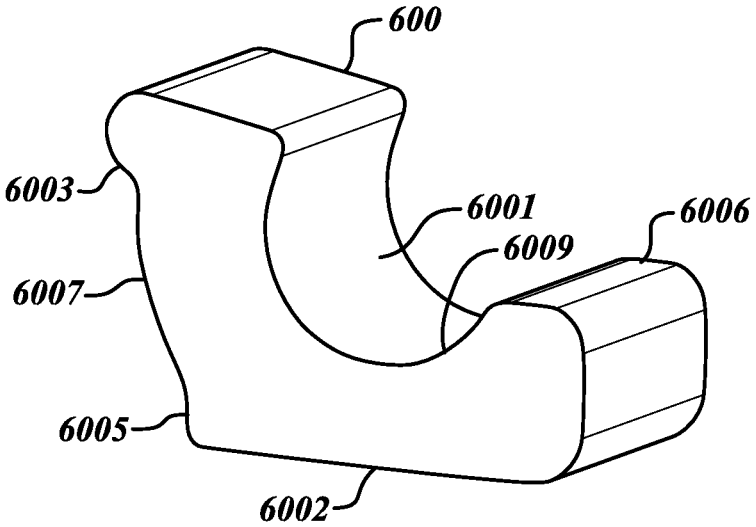
FIG. 11 shows an alternative valve seat insert.

Turning to FIG. 11, valve seat insert 600 can be constrained between first inside surface of the inner arm 200, a second inside surface of the inner arm 210, the outer arm connector 145, and the pivot axle 302. The valve seat insert 600 can comprise a crowned valve surface 6002. To be "crowned," the valve surface 6002 can comprise a curvature so as not to be completely flat. The valve seat insert 600 can comprise an outer leg 6007 and an inner leg 6009. The outer leg can comprise an upper lip 6003 configured to catch against the outer arm connector 145 when the latch arm 220 is pivoted to a first position, such as the latched position. The valve seat insert 600 can comprise a lower lip 6005 configured to catch against the outer arm connector 145 when the latch arm 220 is pivoted to a second position, such as the unlatched or lost motion position. The inner leg can comprise an inner knob or knurl 6006 configured to curl around a portion of the axle 602. The valve seat can comprise an axle groove 6001 for seating the structure flush against the first (pivot) axle 302.

Figure 10A:
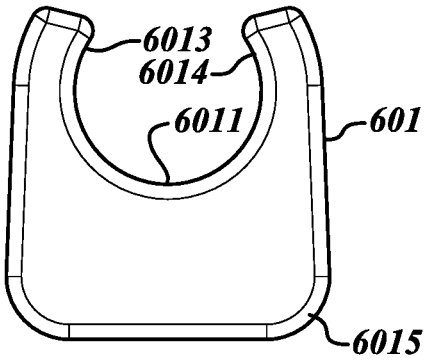
FIGS. 10A & 10B show an alternative valve seat insert.
Figure 10B:
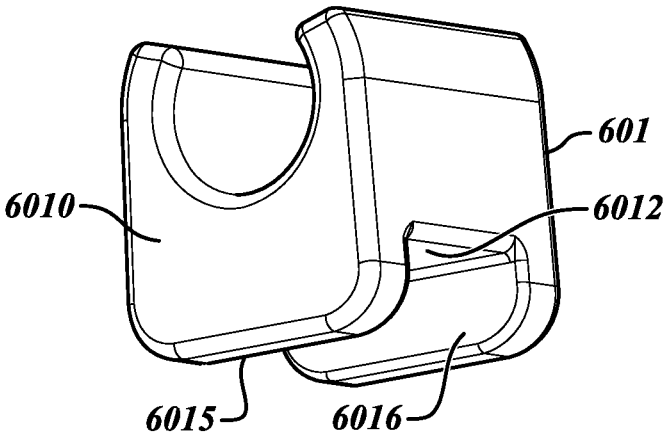

Turning to FIGS. 10A & 10B, and recalling aspects of FIGS. 7C-7F & 8D, alternative valve seat inserts 601, 602 will be discussed. Utilizing valve seat insert 601 or 602, it is not necessary to "basket" the valve seat insert via the outer arm connector 145, and so the outer arm connector 145 can be omitted. To facilitate this, valve seat insert 601 or 602 can be constrained between the first inside surface 250 of the inner arm 200, the second inside surface 251 of the inner arm 210, and the pivot axle 302. The valve seat insert 601 or 602 can comprise a front cusp 6013 configured to encircle a portion of the pivot axle 302 and a rear cusp 6014 configured to encircle a second portion of the pivot axle 302. The valve seat insert 601 or 602 can hang from the pivot axle 302 via the front cusp and the rear cusp. The design permits the valve seat insert to be clipped to the pivot axle or, permits an assembly method whereby inserting the pivot axle unifies the outer arms, inner arms, valve seat insert, and springs. Valve seat insert can be inserted between the lost motion springs 506, 507 or 5060, 5070 to add cross section stiffness The valve seat can further comprise a valve seat body 6010 joined to the front cusp 6013 and to the rear cusp 6014. The valve seat body can be cuboidal, such that it resembles a cube or is an approximate cube shape.

The valve seat body can be flat or can comprise a crowned valve surface 6012. The valve seat body can comprise an axle groove 6011 for seating the valve seat flush against the axle.

Figure 7F:
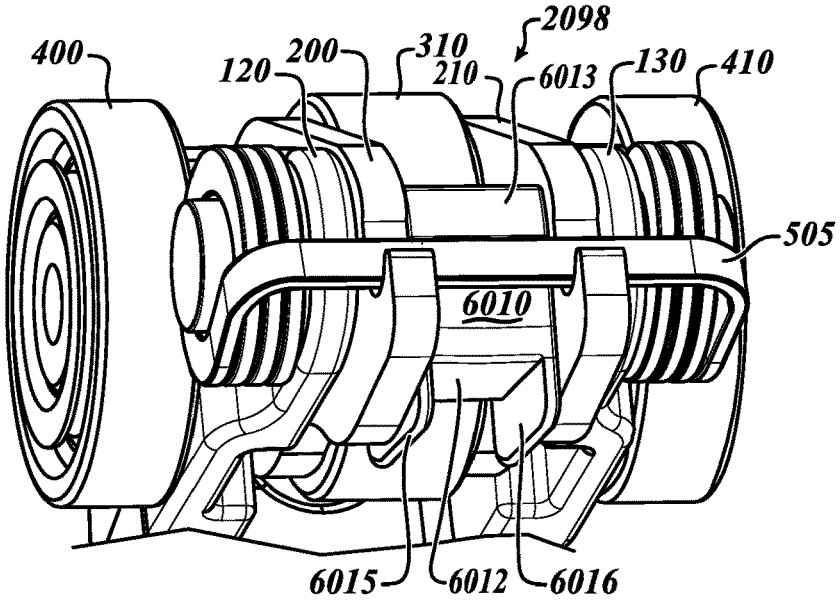

The valve seat insert 602 of FIGS. 7C-7E, 8A, 8B does not comprise valve guides for restricting the lateral motion of the valve stem end 2001, so in some instances hooks, cleats or steps can be included on the inner arm valve guides 240, 241, similar to valve guides 115, to laterally secure the valve stem end 2001. Alternatively, while it is possible to rely on the inner arm valve guides 240, 241 to restrict side-to-side valve stem end motion on the e-foot, FIGS. 7F & 10B illustrate a valve seat insert 601 comprising first and second valve guides 6015 & 6016. The first valve guide 6015 and the second valve guide 6015 can extend away from the valve seat body 6010, the first valve guide and the second valve guide configured to constrain a valve stem end 2001. Then, the inner arms 200, 210 can be lightweighted by removing the valve guides 240, 241. So, the inner arm assembly 2097 of FIGS. 7A-7E can comprise inner arms 200, 210, latch arm 220, and inner roller 310, where inner arms 200, 241 comprise inner arm valve guides 240, 241. But, in FIG. 7F, inner arm assembly 2098 can comprise inner arms 200, 210 without inner arm valve guides 240, 241, latch arm 220, and inner roller 310. Both inner arm assemblies 2097 & 2098 can comprise the hooked spring props 201, 211.

Rocker arms can comprise various mechanisms for retaining a valve stem 2000 for actuation. A valve seat can be distal from the pivot body 11. A first example of a valve seat is a valve pallet 112 that can be integrated, or integrally formed, between the outer arms 120, 130. The valve pallet 112 can comprise a first side 113 for biasing a spring and a second side 114 for receiving a valve stem end 2001. When the cam lobes 1001, 1002, 1003 press on the rocker arm, the rocker arm pivots from the pivot body 111, tipping the rocker arm and pushing the valve pallet 112 towards the cylinder block. This tipping can be seen by comparing FIGS. 12A & 12B. The second side 114 of the valve pallet 112 can comprise a crowned surface, so that it is not perfectly flat, and the valve stem end 2001 can slide slightly on the crowned surface. Valve guides 115 can extend down from the valve pallet to restrain the valve stem motion. The valve pallet 112 can restrict the range of motion of the pivoting inner arms 200, 210.

Alternatively, a valve seat can comprise a valve seat insert 600, 601, 602 that can be retained in the rocker arm. One design comprises valve guides formed on the inner arms 200, 210. The valve guides 240, 241 can be an extension of the inner arms, such as a scallop or other ridge or knurl. Or, the valve guides 240, 241 can comprise hooked ends or cleats to grip the valve stem end 2001. When the inner arms 200, 210 are mounted between the outer arms 120, 130, the first axle 302 constrains the valve seat insert from the top. The valve guides, when hooked or cleated, constrain the valve guide insert from the bottom, and the inside surfaces 250, 251 of the inner arms constrain the valve guide insert at the sides. The valve seat being constrained between the inner arms 200, 210 instead of between the outer arms 120, 130 yields a higher range of motion for pivoting the inner arm assembly 209.

A rocker arm, comprises a first outer arm 120 comprising a first inner side 122, a first outer side 121, a first end 1201, and a second end 1202. A second outer arm 130 comprises a second inner side 132, a second outer side 131, a third end 1303, and a fourth end 1304. A pivot body 111 joins the first end of the first outer arm to the third end of the second outer arm. An outer arm connector 145 can span between the second end of the first outer arm and the fourth end of the second outer arm. An actuatable latch mechanism can reciprocate within the pivot body.

A first inner arm 200 comprises a first inside surface 250 and a first outside surface 260. A second inner arm 210 comprises a second inside surface 251 and a second outside surface 261. A latch arm 220 can be between the first inner arm and the second inner arm, the latch seat pivotable adjacent the pivot body 111 so as to swing past a latch mechanism 900 within the pivot body 111. The latch mechanism 900 can comprise a latch finger 906 that can reciprocate, retracting to release the latch seat 901 from near or against the latch arm 220 of the inner arms 200, 210 or extending to adjoin the latch seat 901 to the latch arm 220 and prevent significant motion of the inner arms.

First axle 302 can join the first inner arm 200 and the second inner arm 210 to pivot between the first outer arm 120 and the second outer arm 130. The first outside surface 260 adjoins the first inner side 122 and the second outside surface 261 adjoins the second inner side 132.

Pump Down Stop

To obtain controlled valvetrain dynamics at high speeds, the lost motion spring 500, 5000, 506, 507, 5060, 5070 on a switching roller finger follower (SRFF) must be of sufficient stiffness. When the stiffness is achieved, it quite often creates a force greater than the hydraulic lash adjuster (HLA) 3000, which will cause the HLA to "pump down." Non-hydraulic lash adjusters can experience strain from the spring. These are undesired outcomes of the spring design. So, travel stops can be designed in to the SRFF, such as those already disclosed above and the following pump-down stop pins 700, 701, 703.

A pump-down stop pin 700, 701, 703 provides hydraulic lash adjuster pump down stop protection. The designs solve the pump-down problem in a unique way for the three roller rocker arm design. FIGS. 4G & 5A-5E show various alternatives.

While a three roller rocker arm has been described, at times, sliders, such as pads or other sliding surfaces, can be used in place of the rollers 400, 410 or 310. The travel stops disclosed herein can be integrated in whether the rocker arm uses rollers or sliders, so that it is advantageous to control the motion of the inner arm with respect to the main body 110. So, it is advantageous to include a pump-down stop, such as a pin 700, extending from the second (bearing) axle 300. Depending on the diameter of the bearing axle 300, and depending on the diameter of one of the post receptacles 124, 125,134, or 135, the pump down stop can alternatively be an integrally formed extension of the bearing axle 300. Integrally formed pin and bearing axle can be drop-in assembled.

Pump-down stop pin 700, 701, 703 can be inserted through one of the post receptacles 124, 125,134, 135, 1351 in posts 123, 133 as described in more detail below. While only one outer arm 120 or 130 need be provided with a post receptacle for inserting the pump-down stop, both arms 120 and 130 can be formed with a receptacle for options during manufacture or for lightweighting or structural balance. While only one pump-down stop is illustrated in several of the figures, two can be used.

Figure 4G:
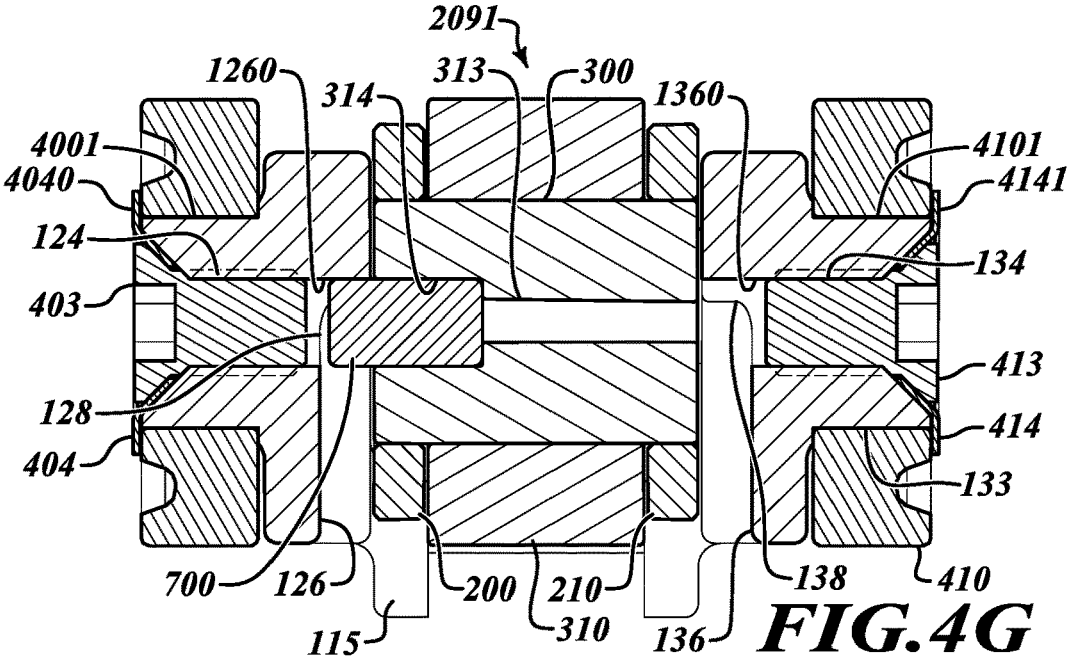

Turning to FIG. 4G, inner sides 122, 132 of the outer arms 120, 130 are formed with grooves 126, 136 to serve as pump-down guides for the pump-down stop. For example, pin 700 can move through one of the grooves 126, 136 as the inner arms 200, 210 pivot within the outer arms 120, 130. A limiting surface 1260, 1360 can be included in the inner sides 122, 132 so that the pump down stop travel is limited. When spring forces from one of springs 500, 506, 507, 509, 5060, 5070 lifts the latch arm 220 and biases the inner roller 310 towards cam lobe 1003 and/or the latch arm 220 to be above latch seat 901, the travel of the latch arm 220 can be limited by the pump-down stop seating against the limiting surface 1260. The grooves 126, 136 can be left unobstructed at the valve-stem side of main body 110 so as to permit a large pivot angle of the inner arms 200, 210 with respect to the outer arms 120, 130.

Figure 5A:
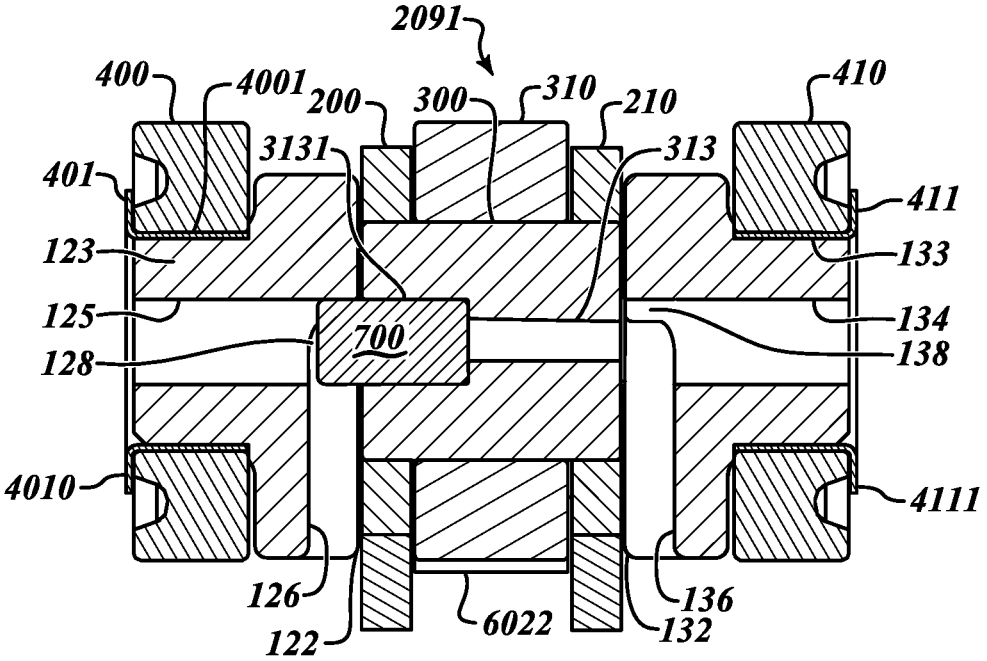
FIGS. 5A-5E show alternative travel stops and roller configurations.

Turning to FIGS. 4G & 5A, inner arm assembly 2091 can comprise inner arms 200, 210, latch arm 220, inner roller 310, and pin 700. Inner roller 310 is shown as comprising multiple layers so that the portion of inner roller 310 that contacts cam lobe 1003 is a different material than bearing axle 300. But, a single, stepped material can be used instead. Of note, however, is that the bearing axle diameter can be adjusted based on the application. For example, it is possible to reduce the weight and inertia of the inner roller by using a smaller diameter bearing axle 300 seated in the inner arms 200, 210. Or, it is possible to lightweight by making the diameter of hollow passageway 313 larger.

Pin 700 can be inserted in pump-down stop receptacle 314 prior to dropping the inner arm assembly 209 within the outer arms 120, 130. Or, pin 700 can be inserted through the post receptacle 125 before or after the pivot axle 302 unifies the inner arm assembly 209 to the outer arms 120, 130. A positioning tool can be inserted through post receptacle 134 or 135 and through hollow passageway 313 to fix the depth of pin 700 within pump-down stop receptacle 314, or to stabilize the location of pump-down stop receptacle as the pin 700 is inserted. A clearance 128 can be maintained between the pin 700 and the fastener 413, or the clearance 128 can be maintained between the pin 700 and the post receptacle. While FIG. 4G comprises threaded post receptacles 124, 134, it is possible to avoid marring such threading via the alignment tool as by using the alternative press-on bushings 401, 411 of FIG. 5A. Then, post receptacles 125, 135 can be unthreaded or smooth.

Figure 5B:
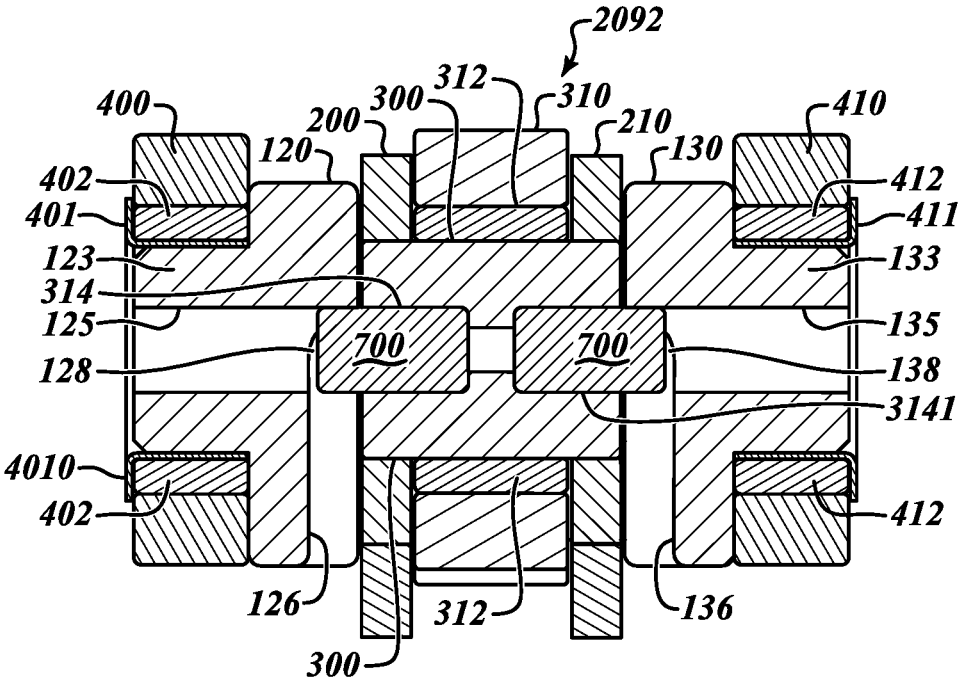

FIG. 5B shows an alternative travel stop, as by comprising two pins 700. Inner arm assembly 2092 can comprise inner arms 200, 210, latch arm 220, inner roller 310, and two pins 700. Also, inner roller 310 can comprise a rotatable bearing 3101 mounted on the second axle 300. Needles 312 can be mounted between the second axle 300 and the rotatable bearing to form a needle bearing assembly. Utilizing two pins 700 can comprise clearance 128 and mirror-image clearance 138. While pins 700 can be assembled in advance of joining the inner arm assembly 209 to the outer arms, it is possible to insert one pin 700 through post receptacle 125 and in to pump-down stop receptacle 313, then insert the other pin 700 through post receptacle 135 and in to pump-down stop receptacle 3131.

Figure 5C:
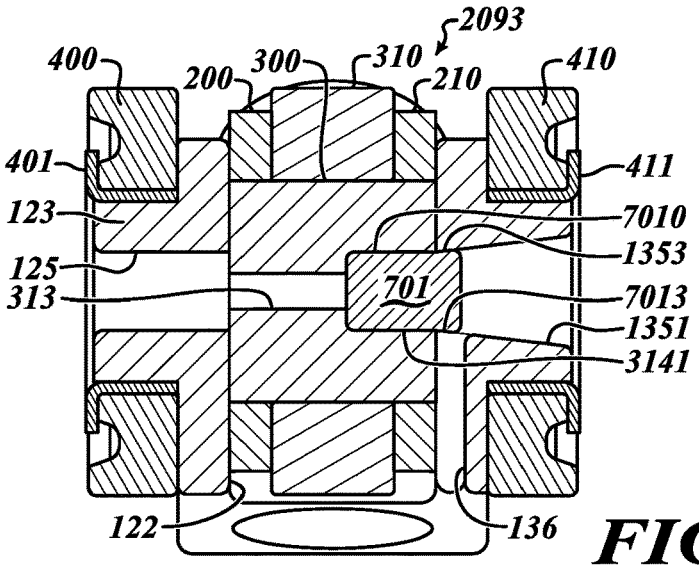
Figure 5D:
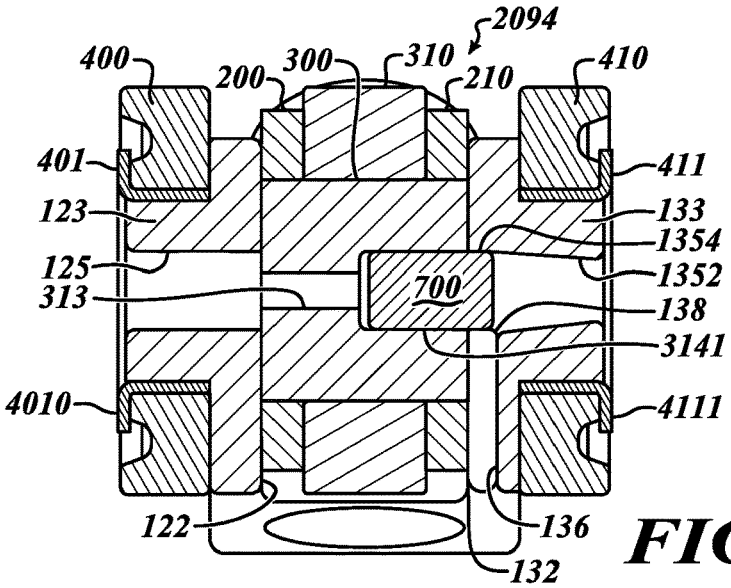
Figure 5E:
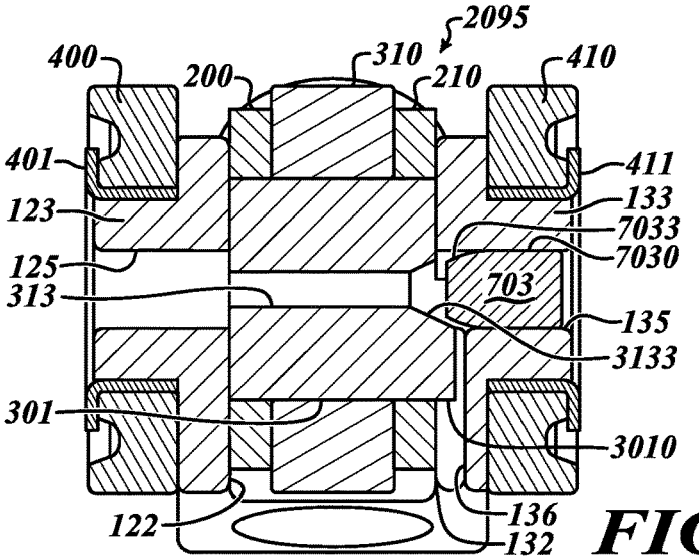

Further alternatives are shown and described in FIGS. 5C-5E. One strategy to set lash between the rocker arm inner roller 310 and the cam lobe 1003 of a 2 step rocker arm is to control tolerances on the inner roller 310, for example, one or more of the inner diameters (ID) and outer diameters (OD) of the rotatable bearing 3101, needles 312, and bearing axle 300. This stack up can add up to many tightly controlled tolerances which makes for costly manufacturing processes. Adding tolerances for the pin 700 alignment increases the stack-up, despite the benefits inured by the travel stop.

Turning to FIG. 5C, inner arm assembly 2093 can comprise inner arms 200, 210, latch arm 220, inner roller 310, and a partially tapered pin 701. To reduce cost, one could use a tapered pin 701, tapered bore for the post receptacle 1351, and pump-down stop receptacle 314 or 3141 for seating the tapered pin 701. One could then control stack up tolerance by the depth of press of the pin 701. The pin 701 can comprise a cylindrical pin body 7010 for fitting in a cylindrical pump-down stop receptacle 314 or 3141. Then, a tapered portion 7013 of the pin can be aligned with respect to the tapered bore of post receptacle 1351.

The control of lash between the cams on cam rail 1000 and the rocker arm rollers 400, 410, 310, in the illustrated case the inner roller 310, can comprise a cost effective way to control stack-up during manufacturing. Additional means are discussed below for using an adjustable means using a taper on a pin or bore.

Instead of an inner roller on a bearing axle, an alternative rocker arm can comprise a slider pad. The slider pan can span between a pair of inner arms. Or, a single inner arm can be used. An axle or other bridge portion between the outer arms can comprise at least a control pin mount, such as receptacles 3131, 314, 3141 or 135.

In FIG. 5D, inner arm assembly 2094 can comprise inner arms 200, 210, latch arm 220, inner roller 310, and a cylindrical pin 700. Pin 700 is cylindrical along its body, as is receptacle 3131. The taper angle of the post receptacle 1352, however, is reversed with respect to FIG. 5C. So, in FIG. 5C, the taper angle increases from the inner side 132 to the outer side 131. But, in FIG. 5D, taper angle decreases from the inner side 132 to the outer side 131. A clearance 138 can be maintained between the end of the pin 700 and the through-portion of the post receptacle 1352, but the position of the pin 700 against the overhanging portion of the tapered post receptacle 1352 will control the location of the travel stop, and hence the lash adjustment. FIG. 5D also illustrates that inner side 122 can be parallel adjacent with outside surface 260.

As in FIG. 5E, inner arm assembly 2095 can comprise inner arms 200, 210, latch arm 220, and an inner roller 310 comprising a control pin stop 3010. Inner roller design can comprise a bearing axle 300 that comprises a control pin stop 3010 or overhang jutting out from the bearing axle in to the pump-down guide 136. A tapered edge 3133 can be included on the control pin stop 3010. One of the outer arms 130 can comprise the a mount for the pin 703, such as post receptacle 135. The pin 703 can comprise a cylindrical body 7030 and a tapered portion 7033. While tapered portion 7033 of pin 701 increased the circumference of the pin as the taper extended from the cylindrical pin body 7030, this pin 703 decreases the circumference of the pin as the taper extends from the cylindrical pin body 7030. The inner arm assembly 209 comprises a tapered edge 3133 as a control pin stop. Setting the pin 703 in the post receptacle 135 or other mount with respect to the control pin stop sets the relative motion of the inner arm assembly 209 with respect to the outer arms 120, 130.

Instead of using only tolerance to control the lash, one could design an adjustable stop pin 700, 701, 703 according to the instant disclosure. When tapered, the pin 701, 703 can taper at the same angle as the tapered bore against which is provided a travel stop (control pin stop). To adjust the lash, one presses the pin into the pin bore to a given depth: more depth for more lash or less depth for less lash in the example of FIG. 5C. This depth will depend on the amount of lash one wants between the inner roller 310 and the inner cam lobe 1003. One could use a gauge or other alignment tool to hold the rocker arm in a position that aligns the inner and outer rollers 400, 410 to the desired lash for the operating state. Then, when the stop pin 701, 703 is inserted and set (or pressed into its bore) it is pressed to the depth that aligns the parts with the gauge or other alignment tool.

Consistent with these examples, a rocker arm can comprise a first outer arm 120 and a second outer arm 130 joined by a pivot body 111. One of the first outer arm or the second outer arm comprises an inner side 122, 132, and the inner side comprises a limiting surface 1260, 1360, 1352, 1354. Second (bearing) axle 300 can be between the first inner arm and the second inner arm. A pin 700, 701 can extend from the second axle 300 towards one of the first outer arm or the second outer arm. The pin can be configured to reciprocate towards and away from the limiting surface when the first inner arm and the second inner arm pivot between the first outer arm and the second outer arm.

The inner side can further comprise a groove 126, 136 with the limiting surface 1260, 1360, 1352, 1354, and the pin 700, 701 can be configured to pivot within the groove towards and away from the limiting surface when the first inner arm and the second inner arm pivot between the first outer arm and the second outer arm (for example, when the inner arm assembly 209 travels in lost motion).

A rocker arm can comprise a pair of outer arms 120, 130 comprising at least one control pin port, such as port receptacles 124, 134, 125, 135, 1351, 1352 through at least one of the outer arms of the pair of outer arms. An inner arm assembly 209 can be pivotable with respect to the outer arms. The inner arm assembly can comprise at least one pin mount, such as receptacles 3131, 314, 3141, which can be part of an axle 300 or other portion of the inner arm assembly 209. A control pin 701, 703 can comprise a tapered portion 7033, 7013 and a body portion 7030, 7013, the control pin body inserted in to the control pin mount, and at least a portion of the tapered portion selectively in contact with at least a portion of the control pin port.

The pump-down stops disclosed herein can be used with less complicated rocker arms that those disclosed in the figures. For example, the pump-down stops can be used in a rocker arm lacking the cantilevered rollers 400, 410. So, a rocker arm can comprise a pair of outer arms comprising at least one limiting surface 260, 360, 1353, 1354, on at least one of the outer arms of the pair of outer arms. An inner arm assembly can be pivotable with respect to the outer arms. A control pin 700, 701 can be mounted to the inner arm so as to limit the travel of the inner arm assembly with respect to the outer arms.

Or, a rocker arm can comprise a pair of outer arms comprising at least one control pin mount, such as port receptacle 135 on at least one of the outer arms of the pair of outer arms. An inner arm assembly can be pivotable with respect to the outer arms. The inner arm can comprise a limiting surface such as tapered edge 3133. A control pin, such as pin 703 comprising a tapered portion and a body portion, can be inserted in to the control pin mount. At least a portion of the tapered portion 7033 can selectively be in contact with at least a portion of the limiting surface.

Roller Retention for Three Roller Rocker Arm

Using rollers, such as roller bearings, needle bearings, or wheels, on a rocker arm reduces friction losses when the actuation mechanism pushes against the rocker arm. Consider a type II valvetrain comprising an overhead cam rail 1000. Eccentrically shaped cam lobes are mounted to rotate with the cam rail 1000, and the shape of the lobes 1001, 1002, 1003 and the rotation rate of the cam rail 1000 controls the opening and closing of the engine valves. If using immobile surfaces, such as slider pads, the cam lobes scrape along the slider pads, which can lead to energy loss in the system. Using rollers on the rocker arm, instead of immobile surfaces like slider pads, lowers friction losses. So, it can be advantageous to use a roller 310 for the lost motion pivoting of the inner arms 200, 210 and it can be further advantageous to use first and second outer rollers 400, 410 on the first and second outer arms 120, 130. The roller 310 can comprise a needle roller bearing, as above. Like and additional adaptations for the outer rollers 400, 410 will be detailed below.

By cantilevering the outer rollers 400, 410 on posts 123, 133 on outer sides 121, 131 of the outer arms 120, 130, assembly and manufacture benefits inure.

A rocker arm can comprise a first outer arm 120 comprising a first inner side 122 and a first outer side 121, the first outer side comprising a first cantilevered post 123. A first roller 400 can be mounted to the first cantilevered post 123. A second outer arm 130 comprises a second inner side 132 and a second outer side 131, the second inner side 132 facing the first inner side 122. The second outer side 131 comprises a second cantilevered post 133. A second roller 410 is mounted to the second cantilevered post 133.

The first cantilevered post 123 can be integrally formed with the first outer side 121, as by molding, machining, printing or the like. Likewise, the second cantilevered post 133 can be integrally formed with the second outer side 131. First roller 400 can be cantilevered on mounting post 123 in-line with the second axle 300, which can be in-line with the second roller 410.

The first and second cantilevered posts 123, 133 can comprise first and second post receptacles 124, 134 or 125, 135 configured to receive a pin 700 and or a fastener 403, 413. The fastener can be a rivet or the like. Or, first and second post receptacles 124, 134 can be threaded to receive a threaded fastener 402, 413. The first roller 400 can comprise a center hole 4001, and the first roller can be mounted to the first cantilevered post by inserting a fastener such as screw or rivet 403, 413 or bushing 401, 411 through the center hole 400 land by securing the fastener to the first cantilevered post 123. The outer rollers can be retained by extensions 4040, 4041 on the washers being held in place by screwing in the fasteners. Like process can be used for second roller 410 comprising center hole 4101.

The first roller 400 can be mounted to the first cantilevered post 123 by inserting a fastener 403 through the center hole 4001 and in to the first post receptacle 124 or 134. A washer 404, 414 or bushing can be inserted between the respective first roller 400 or second roller 410 and the fastener 403, 413 to facilitate rotation of the outer rollers 400, 410, as can be seen in FIG. 4G.

Alternatively, as seen in FIG. 5A, the first and second cantilevered posts 123, 133 can comprise outer surfaces, and fasteners 401, 411 can be fitted to the outer surfaces. The fasteners 401, 411 can be T-bushings, and the T-bushings can be press-fit to the outer surface. T-bushings can function to facilitate rotation of the outer rollers and to retain the outer rollers. By using the "T" cross-section, extensions 4010, 4111 on the T-bushings provides lateral travel limitations to the outer rollers 400, 410, which prevents twisting forces from conveying to the cam lobes 1001, 1002. Similar extensions 4040, 4141 can be provided on the washers 404, 414.

As shown in FIG. 5B, the rocker arm can further comprise needles 402, 412 between the outer rollers 400, 410. The outer rollers 400, 410 can constitute outer races for bearing assemblies, and the bushings 401, 411 can constitute inner races for the bearing assemblies. The center holes 4001, 4101 can be larger diameter to accommodate the needles 402, 412. Extensions 4010, 4111 can restrict the needles 402, 412 and the outer rollers 400, 410 from moving on the cantilevered posts 123, 133.

Other implementations will be apparent to those skilled in the art from consideration of the specification and practice of the examples disclosed herein.

What is claimed is:

1. A rocker arm, comprising:

an outer arm assembly, comprising:

a first outer arm comprising a first inner side, a first outer side, a first end, and a second end;

a second outer arm comprising a second inner side, a second outer side, a third end, and a fourth end;

a pivot body joined between the first end of the first outer arm and the third end of the second outer arm;

an outer arm connector spanning between the second end of the first outer arm and the fourth end of the second outer arm so that the outer arm connector is at an opposite end of the outer arm assembly than the pivot body; and an actuatable latch mechanism within the pivot body;

an inner arm assembly within the outer arm assembly, the inner arm assembly comprising a latch arm pivotable adjacent the pivot body;

a pivot axle joining the inner arm assembly to pivot between the first outer arm and the second outer arm; and a valve seat insert constrained within the inner arm assembly between the outer arm connector and the pivot axle, the outer arm connector forming a travel limit for the valve seat insert as the valve seat insert pivots around the pivot axle.

2. The rocker arm of claim 1, wherein inner arm assembly comprises:

a first inner arm comprising a first inside surface and a first outside surface;

a second inner arm comprising a second inside surface and a second outside surface; and the latch arm between the first inner arm and the second inner arm, wherein the first outside surface adjoins the first inner side and wherein the second outside surface adjoins the second inner side.

3. The rocker arm of claim 2, wherein the valve seat insert is constrained within the inner arm assembly between the first inside surface, the second inside surface, the outer arm connector, and the pivot axle.

4. The rocker arm of claim 1, wherein the valve seat insert comprises an "L" shape.

5. The rocker arm of claim 3, wherein the first inside surface and the second inside surface of the inner arm assembly apply a clamp force to the valve seat insert.

6. The rocker arm of claim 1, wherein the valve seat insert comprises a crowned valve seat.

7. The rocker arm of claim 1, wherein the valve seat insert comprises an outer leg and an inner leg, and wherein the outer leg comprises an upper lip configured to catch against the outer arm connector when the latch arm is pivoted to a first position.

8. The rocker arm of claim 7, wherein the valve seat insert comprises a lower lip configured to catch against the outer arm connector when the latch arm is pivoted to a second position.

9. The rocker arm of claim 7, wherein the inner leg comprises an inner knob configured to curl around a portion of the pivot axle.

10. The rocker arm of claim 1, wherein the valve seat insert comprises an axle groove for seating the valve seat insert flush against the pivot axle.

11. The rocker arm of claim 1, wherein the first outer side comprises a first cantilevered post, wherein the second outer side comprises a second cantilevered post, and wherein the rocker arm further comprises a first roller mounted to the first cantilevered post; and a second roller mounted to the second cantilevered post.

12. A rocker arm for a valvetrain, comprising:

a first outer arm comprising a first inner side and a first outer side;

a second outer arm comprising a second inner side and a second outer side;

a pivot body joined between the first inner side and the second inner side;

a pivot axle between the first outer arm and the second outer arm; and a valve seat insert comprising a front cusp configured to encircle a portion of the pivot axle and a rear cusp configured to encircle a second portion of the pivot axle, wherein the valve seat insert hangs from the pivot axle via the front cusp and the rear cusp.

13. The rocker arm of claim 12, further comprising:

an actuatable latch mechanism within the pivot body;

an inner arm assembly comprising a latch arm pivotable adjacent the pivot body;

wherein the pivot axle joins the inner arm assembly to pivot between the first outer arm and the second outer arm.

14. The rocker arm of claim 13, wherein inner arm assembly comprises:

a first inner arm comprising a first inside surface and a first outside surface;

a second inner arm comprising a second inside surface and a second outside surface; and the latch arm between the first inner arm and the second inner arm, wherein the first outside surface adjoins the first inner side and wherein the second outside surface adjoins the second inner side.

15. The rocker arm of claim 14, wherein the valve seat insert is constrained within the inner arm assembly between the first inside surface, the second inside surface, and the pivot axle.

16. The rocker arm of claim 13, wherein the latch arm is adjacent the pivot body, and wherein the pivot axle is distal from the latch arm.

17. The rocker arm of claim 14, wherein the first inner arm and the second inner arm are joined to the first outer arm and to the second outer arm only by the pivot axle.

18. The rocker arm of claim 14, wherein the valve seat insert is clamped in the inner arm assembly between the first inside surface and the second inside surface.

19. The rocker arm of claim 12, wherein the valve seat insert further comprises a valve seat body joined to the front cusp and to the rear cusp.

20. The rocker arm of claim 19, wherein the valve seat body comprises a crowned valve surface.

21. The rocker arm of claim 19, wherein the valve seat body comprises an axle groove for seating the valve seat flush against the pivot axle.

22. The rocker arm of claim 19, wherein the valve seat insert further comprises a first valve guide and a second valve guide extending away from the valve seat body, the first valve guide and the second valve guide configured to constrain a valve stem.

23. The rocker arm of claim 19, wherein the valve seat body is cuboidal.

24. The rocker arm of claim 12, further comprising a spring coiled around the pivot axle, the spring biased against one of the first outer arm and the second outer arm and further biased against a spring prop on one of the first inner arm and the second inner arm.

25. The rocker arm of claim 12, wherein the first inner arm comprises a first spring prop, wherein the second inner arm comprises a second spring prop, and wherein the rocker arm further comprises a spring coiled around opposed ends of the pivot axle, the spring biased against the first outer arm and against the second outer arm and further biased against the first spring prop on the first inner arm and the second spring prop on the second inner arm.

26. The rocker arm of claim 12, wherein the actuatable latch mechanism reciprocates within the pivot body between a first position adjoining the latch arm and a second position withdrawn from the latch arm.

27. The rocker arm of claim 12, further comprising a second axle mounted between the first inner arm and the second inner arm; and a rotatable bearing mounted on the second axle.

28. The rocker arm of claim 12, wherein the first outer side comprises a first cantilevered post, wherein the second outer side comprises a second cantilevered post, and wherein the rocker arm further comprises a first roller mounted to the first cantilevered post; and a second roller mounted to the second cantilevered post.

29. A type II valvetrain, comprising:

a rocker arm assembly, comprising:

a first outer arm comprising a first inner side and a first outer side;

a second outer arm comprising a second inner side and a second outer side;

a pivot body joined between the first inner side and the second inner side;

a pivot axle between the first outer arm and the second outer arm; and a valve seat insert comprising a front cusp configured to encircle a portion of the pivot axle and a rear cusp configured to encircle a second portion of the pivot axle, wherein the valve seat insert hangs from the pivot axle via the front cusp and the rear cusp; and first, second, and third rotating cam lobes, where the first cam lobe is configured to press upon the first outer arm, where the second cam lobe is configured to press upon the second outer arm, and, wherein the third cam lobe is configured to selectively push the inner arm assembly to rotate past the actuatable latch mechanism when the actuatable latch mechanism is in an unlatched position.

30. The type II valvetrain of claim 29, wherein the inner arm assembly is biased by a spring force towards the third cam lobe.

* * * * *